US009343038B2

(12) United States Patent
Jiko

(10) Patent No.: US 9,343,038 B2
(45) Date of Patent: May 17, 2016

(54) IMAGE PROJECTION APPARATUS AND IMAGE DISPLAY SYSTEM

(71) Applicant: CANON KABUSHIKI KAISHA, Tokyo (JP)

(72) Inventor: Takuma Jiko, Utsunomiya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 149 days.

(21) Appl. No.: 14/314,883

(22) Filed: Jun. 25, 2014

(65) Prior Publication Data

US 2015/0015470 A1 Jan. 15, 2015

(30) Foreign Application Priority Data

Jul. 10, 2013 (JP) ..... 2013-144055

(51) Int. Cl.
*G09G 5/10* (2006.01)
*G09G 5/00* (2006.01)
*G09G 3/00* (2006.01)

(52) U.S. Cl.
CPC ..... *G09G 5/003* (2013.01); *G09G 3/001* (2013.01); *G09G 2320/0233* (2013.01); *G09G 2320/0693* (2013.01); *G09G 2360/141* (2013.01)

(58) Field of Classification Search
None
See application file for complete search history.

(56) References Cited

U.S. PATENT DOCUMENTS

| | | | | |
|---|---|---|---|---|
| 7,529,405 | B2 | 5/2009 | Masuno et al. | |
| 8,149,293 | B2 | 4/2012 | Utsugi | |
| 2013/0050545 | A1 | 2/2013 | Komatsu | |
| 2014/0327706 | A1 * | 11/2014 | Nakai | G09G 5/10 345/690 |

FOREIGN PATENT DOCUMENTS

| | | | |
|---|---|---|---|
| JP | 06-233144 | A | 8/1994 |
| JP | 2006-135745 | A | 5/2006 |
| JP | 2009-199098 | A | 9/2009 |
| JP | 2009-267690 | A | 11/2009 |
| JP | 2011-223350 | A | 11/2011 |
| JP | 2013-046380 | A | 3/2013 |

* cited by examiner

*Primary Examiner* — Adam R Giesy
(74) *Attorney, Agent, or Firm* — Rossi, Kimms & McDowell LLP

(57) ABSTRACT

An image projection apparatus configured to project an image on the projection surface includes a light modulation unit configured to modulate light from a light source unit, an image processing unit configured to generate an image signal to be input to the light modulation unit, disposed in the image projection apparatus and, a light intensity measuring unit configured to measure an intensity of part of the modulated by the light modulation unit, a light guide optical system configured to guide the part of the light to the light intensity measuring unit and another part of the light to the projection surface, and a correction unit configured to correct brightness of the image projected on the projection surface based on a video signal supplied to the image projection apparatus and a measurement result of the light intensity measuring unit.

22 Claims, 15 Drawing Sheets

TEST PATTERN AND IMAGE BRIGHTNESS PER REGION

| TEST PATTERN | CONTENT | IMAGE BRIGHTNESS PER REGION $BI_N$ | | | | | | | | |
|---|---|---|---|---|---|---|---|---|---|---|
| | | $BI_A$ | $BI_B$ | $BI_C$ | $BI_D$ | $BI_E$ | $BI_F$ | $BI_G$ | $BI_H$ | $BI_I$ |
| IMAGE 1 | TEST PATTERN FOR AF | 100 | 100 | 100 | 100 | 100 | 100 | 75 | 75 | 75 |
| IMAGE 2 | TEST PATTERN FOR AK | 75 | 75 | 75 | 90 | 50 | 90 | 75 | 75 | 75 |
| IMAGE 3 | IMAGE DISPLAYED IN TERMINATION SEQUENCE | 70 | 70 | 70 | 62 | 50 | 66 | 70 | 70 | 70 |
| IMAGE 4 | ALL WHITE (BRIGHTNESS 100%) | 200 | 200 | 200 | 200 | 200 | 200 | 200 | 200 | 200 |
| ⋮ | ⋮ | ⋮ | ⋮ | ⋮ | ⋮ | ⋮ | ⋮ | ⋮ | ⋮ | ⋮ |

FIG. 2A

TABLE FOR CONVERSION BETWEEN IMAGE BRIGHTNESS AND OUTPUT VALUE OF LIGHT INTENSITY SENSOR

| IMAGE BRIGHTNESS (BI) | 0 | 1 | 2 | ··· | 100 | ··· | 255 |
|---|---|---|---|---|---|---|---|
| OUTPUT VALUE OF LIGHT INTENSITY SENSOR (OV) | 210 | 210 | 211 | ··· | 320 | ··· | 1020 |

FIG. 2B

CORRECTION VALUE OF LIGHT INTENSITY SENSOR VALUE PER REGION OF DISPLAY IMAGE

| CORRECTION VALUE OF OUTPUT VALUE OF LIGHT INTENSITY SENSOR $n_1$ | $a_1$ | $b_1$ | $c_1$ | $d_1$ | $e_1$ | $f_1$ | $g_1$ | $h_1$ | $i_1$ |
|---|---|---|---|---|---|---|---|---|---|
| SET VALUE | 0.05 | 0.1 | 0.05 | 0.1 | 0.4 | 0.1 | 0.05 | 0.1 | 0.05 |

FIG. 2C

CORRECTION VALUE OF IMAGE BRIGHTNESS AND CHANGE AMOUNT OF ELECTRICAL POWER SUPPLIED TO LAMP

| CORRECTION VALUE OF IMAGE BRIGHTNESS Bri | CHANGE AMOUNT OF ELECTRICAL POWER SUPPLIED TO LAMP $cPow_n$ |
|---|---|
| ⋮ | ⋮ |
| −2 | $cPow_{-2}$ |
| −1 | $cPow_{-1}$ |
| 0 | $cPow_0$ |
| 1 | $cPow_1$ |
| 2 | $cPow_2$ |
| ⋮ | ⋮ |

FIG. 2D

| CORRECTION VALUE OF IMAGE BRIGHTNESS Bri | $\gamma$ VALUE CHANGE AMOUNT |
|---|---|
| ⋮ | ⋮ |
| −2 | $c\gamma_{-2}$ |
| −1 | $c\gamma_{-1}$ |
| 0 | $c\gamma_{0}$ |
| 1 | $c\gamma_{1}$ |
| 2 | $c\gamma_{2}$ |
| ⋮ | ⋮ |

TEST PATTERN A

TEST PATTERN B

TEST PATTERN C

TEST PATTERN D

TEST PATTERN E

TEST PATTERN F

TEST PATTERN G

TEST PATTERN H

TEST PATTERN I

TEST PATTERN AND IMAGE BRIGHTNESS PER REGION

| TEST PATTERN | CONTENT | IMAGE BRIGHTNESS PER REGION | |
|---|---|---|---|
| | | REGION | BRIGHTNESS (R,G,B) |
| TEST PATTERN $A_R$ | DISPLAYING R SOLID IMAGE ONLY IN REGION A | A | $BI_{AR}$ = (100, 0, 0) |
| TEST PATTERN $B_R$ | DISPLAYING R SOLID IMAGE ONLY IN REGION B | B | $BI_{BR}$ = (100, 0, 0) |
| TEST PATTERN $C_R$ | DISPLAYING R SOLID IMAGE ONLY IN REGION C | C | $BI_{CR}$ = (100, 0, 0) |
| ⋮ | ⋮ | | ⋮ |
| TEST PATTERN $I_B$ | DISPLAYING B SOLID IMAGE ONLY IN REGION I | I | $BI_{IB}$ = (0, 0, 100) |

FIG. 10A

TABLE FOR CONVERSION BETWEEN IMAGE BRIGHTNESS AND OUTPUT VALUE OF LIGHT INTENSITY SENSOR

| IMAGE BRIGHTNESS (BI) | 0 | 1 | 2 | ··· | 100 | ··· | 255 |
|---|---|---|---|---|---|---|---|
| OUTPUT VALUE OF LIGHT INTENSITY SENSOR ($OV_R$) | 210 | 210 | 210 | ··· | 370 | ··· | 650 |
| OUTPUT VALUE OF LIGHT INTENSITY SENSOR ($OV_G$) | 210 | 210 | 211 | ··· | 420 | ··· | 1020 |
| OUTPUT VALUE OF LIGHT INTENSITY SENSOR ($OV_B$) | 210 | 210 | 210 | ··· | 320 | ··· | 380 |

FIG. 10B

CORRECTION VALUE OF LIGHT INTENSITY SENSOR VALUE PER REGION OF DISPLAY IMAGE

| DISPLAY IMAGE REGION | $a_2$ | $b_2$ | $c_2$ | $d_2$ | $e_2$ | $f_2$ | $g_2$ | $h_2$ | $i_2$ |
|---|---|---|---|---|---|---|---|---|---|
| CORRECTION VALUE OF OUTPUT VALUE OF LIGHT INTENSITY SENSOR | 0.05 | 0.1 | 0.05 | 0.1 | 0.4 | 0.1 | 0.05 | 0.1 | 0.05 |

FIG. 10C

| | | SET $\gamma$ VALUE | | |
|---|---|---|---|---|
| | | $\gamma_R$ | $\gamma_G$ | $\gamma_B$ |
| CORRECTION VALUE OF LUMINANCE/ CHROMATICITY UNEVENNESS | ⋮ | ⋮ | ⋮ | ⋮ |
| | $Ue_{-2}$ | $c\gamma_{(R,-2)}$ | $c\gamma_{(G,-2)}$ | $c\gamma_{(B,-2)}$ |
| | $Ue_{-1}$ | $c\gamma_{(R,-1)}$ | $c\gamma_{(G,-1)}$ | $c\gamma_{(B,-1)}$ |
| | $Ue_{0}$ | $c\gamma_{(R,0)}$ | $c\gamma_{(G,0)}$ | $c\gamma_{(B,0)}$ |
| | $Ue_{-1}$ | $c\gamma_{(R,1)}$ | $c\gamma_{(G,1)}$ | $c\gamma_{(B,1)}$ |
| | $Ue_{-2}$ | $c\gamma_{(R,2)}$ | $c\gamma_{(G,2)}$ | $c\gamma_{(B,2)}$ |
| | ⋮ | ⋮ | ⋮ | ⋮ |

TABLE FOR RELATION OF INCREMENT OF OUTPUT VALUE OF LIGHT INTENSITY SENSOR FOR ONE PIXEL AT LUMINANCE PV

| IMAGE BRIGHTNESS (PV) | 0 | 1 | ··· | 255 |
|---|---|---|---|---|
| INCREMENT OF OUTPUT VALUE OF LIGHT INTENSITY SENSOR FOR ONE PIXEL AT LUMINANCE PV ($IV_{PV}$) | 0 | 2.63E−08 | ··· | 4.16E−03 |

FIG. 15A

CORRECTION VALUE OF LIGHT INTENSITY SENSOR PER REGION OF DISPLAY IMAGE

| DISPLAY IMAGE REGION | $a_3$ | $b_3$ | $c_3$ | $d_3$ | $e_3$ | $f_3$ | $g_3$ | $h_3$ | $i_3$ | $SV_{BK}$ |
|---|---|---|---|---|---|---|---|---|---|---|
| CORRECTION VALUE OF OUTPUT VALUE OF LIGHT INTENSITY SENSOR | 0.05 | 0.1 | 0.05 | 0.1 | 0.4 | 0.1 | 0.05 | 0.1 | 0.05 | 338 |

FIG. 15B

CORRECTION VALUE OF IMAGE BRIGHTNESS AND CHANGE AMOUNT OF ELECTRICAL POWER SUPPLIED TO LAMP

| CORRECTION VALUE OF IMAGE BRIGHTNESS Bri | CHANGE AMOUNT OF ELECTRICAL POWER SUPPLIED TO LAMP |
|---|---|
| ⋮ | ⋮ |
| −2 | $cPow_{-2}$ |
| −1 | $cPow_{-1}$ |
| 0 | $cPow_0$ |
| 1 | $cPow_1$ |
| 2 | $cPow_2$ |
| ⋮ | ⋮ |

FIG. 15C

| CORRECTION VALUE OF IMAGE BRIGHTNESS Bri | $\gamma$ VALUE CHANGE AMOUNT |
|---|---|
| ⋮ | ⋮ |
| −2 | $c\gamma_{-2}$ |
| −1 | $c\gamma_{-1}$ |
| 0 | $c\gamma_{0}$ |
| 1 | $c\gamma_{1}$ |
| 2 | $c\gamma_{2}$ |
| ⋮ | ⋮ |

FIG. 16

IMAGE PROJECTION APPARATUS AND IMAGE DISPLAY SYSTEM

BACKGROUND OF THE INVENTION

1. Field of the Invention

The present invention relates to an image projection apparatus configured to control at least one of a light source unit and a light modulation unit.

2. Description of the Related Art

An image projection apparatus such as a projector is capable of projecting any image by modulating light from a light source unit at a light modulation unit and projecting the modulated light on a projection surface. The image projection apparatus includes, for example, a lamp or an LED as the light source unit and a liquid crystal panel as the light modulation unit.

In such an image projection apparatus, aging of the light source unit and the light modulation unit changes the brightness of the image projected on the projection surface. The aging of the light source unit changes its output and hence the luminance of the projected image. Furthermore, the aging of the light modulation unit changes the modulation efficiency of the light and hence the luminance and chromaticity of the projected image. This prevents the projected image from being projected at desired brightness in some cases.

Japanese Patent Laid-open No. 2009-199098 discloses a projector that controls one of a light source and a spatial light modulation device based on a relation between the temperature and luminance distribution of the light source and thereby reduces uneven color. Japanese Patent Laid-open No. 2009-199098 discloses a configuration in which a plurality of light sensors are arranged in a matrix and the spatial light modulation device is controlled based on the luminance distributions of RGB lights to make the luminance distributions identical, thereby keeping the brightness even and reducing uneven color. Japanese Patent Laid-open No. 2011-223350 discloses a projector that adjusts a drive signal of each panel based on a test image of even chromaticity by using illuminance/chromaticity sensors distributed on a light shielding shutter, thereby reducing change due to aging in the brightness of an image projected on a projection surface.

However, the configuration disclosed in Japanese Patent Laid-open No. 2009-199098 cannot, when a correlation between values measured at the sensors and the brightness of the projected image changes, keep even the brightness with high accuracy and cannot reduce uneven color. To correct the brightness and uneven color based on the luminance distributions measured at the light sensors, the light sensors need to be arranged in a matrix, which increases cost for the sensors.

In the configuration disclosed in Japanese Patent Laid-open No. 2011-223350, the light shielding shutter needs to be closed to measure the illuminance/chromaticity of the projected image with the illuminance/chromaticity sensors. The illuminance/chromaticity thus cannot be measured while the image is being projected. Furthermore, the light shielding shutter needs a plurality of illuminance/chromaticity sensors, which increases cost for the sensors.

SUMMARY OF THE INVENTION

The present invention provides an image projection apparatus and an image display system that are capable of highly accurately adjusting to an optional projection light intensity at low cost.

An image projection apparatus as one aspect of the present invention is an image projection apparatus configured to project an image on a projection surface, the image projection apparatus comprising a light modulation unit configured to modulate light from a light source unit, an image processing unit configured to generate an image signal to be input to the light modulation unit, a light intensity measuring unit disposed in the image projection apparatus and configured to measure an intensity of part of the light modulated by the light modulation unit, a light guide optical system configured to guide the part of the light to the light intensity measuring unit and another part of the light to the projection surface, and a correction unit configured to correct brightness of the image projected on the projection surface based on an image signal supplied to the image projection apparatus and a measurement result of the light intensity measuring unit.

An image display system as another aspect of the present invention includes the image projection apparatus and an image supply apparatus configured to supply image information to the image projection apparatus.

Further features and aspects of the present invention will become apparent from the following description of exemplary embodiments with reference to the attached drawings.

BRIEF DESCRIPTION OF THE DRAWINGS

FIGS. 2A to 2D are data tables for an image brightness correction stored in a memory in the first embodiment.

FIGS. 10A to 10C are data tables for a luminance/chromaticity unevenness correction stored in a memory in the second embodiment.

FIGS. 15A to 15C are data tables for an image brightness correction stored in a memory in the third embodiment.

FIG. 16 is a data table for the image brightness correction stored in an image correction circuit in the third embodiment.

DESCRIPTION OF THE EMBODIMENTS

Figure 1:
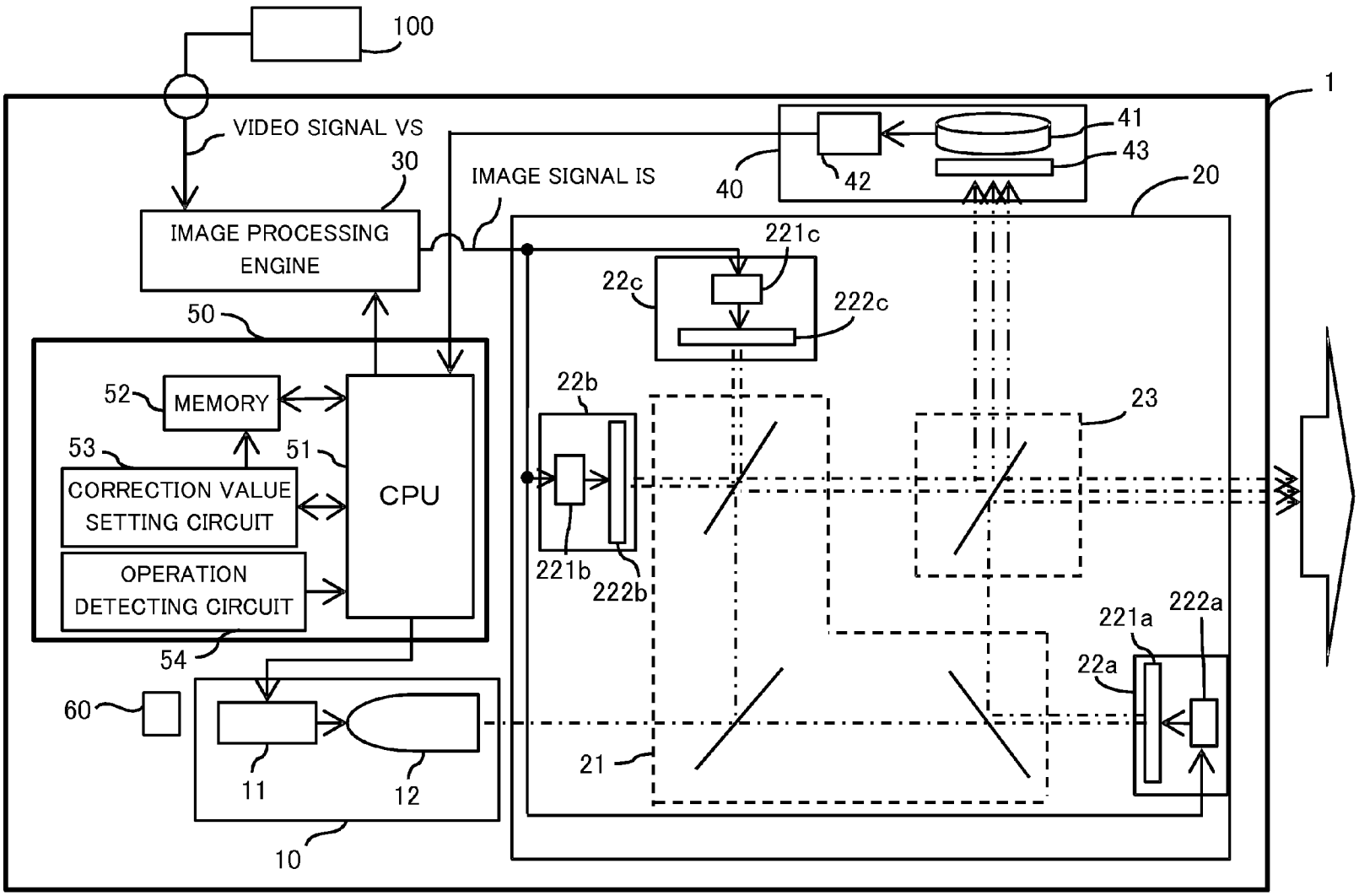
FIG. 1 is a schematic configuration diagram of an image projection apparatus in a first embodiment.

Exemplary embodiments of the present invention will be described below with reference to the accompanied drawings.

In each of the drawings, the same elements will be denoted by the same reference numerals and the duplicate descriptions thereof will be omitted.

First Embodiment

First, referring to FIG. 1, an image projection apparatus in a first embodiment of the present invention will be described. FIG. 1 is a schematic configuration diagram of a projector 1 (image projection apparatus) in the present embodiment. The projector 1 in the present embodiment allows reduction in cost for sensors and is capable of adjusting the brightness of a projected image with a predetermined accuracy even when a correlation between a value measured by a light intensity measuring unit and the brightness of the projected image has changed.

The projector 1 (image projection apparatus) projects an image on a projection surface such as a screen. The projector 1 includes a lamp unit 10 (light source unit), a light modulation unit 20 (light modulation unit), an image processing engine 30 (image processing unit), a light intensity sensor 40 (light intensity measuring unit), and a correction circuit 50 (correction unit). The present embodiment describes the projector 1 as a reflective liquid crystal projector, but the present invention is also applicable to other image projection apparatuses such as a digital light processing (DLP) projector.

The lamp unit 10 includes a light source driving circuit 11 and a lamp 12 (light source). The light source driving circuit 11 controls, based on a control signal from the correction circuit 50, an electrical power to be supplied to the lamp 12. The lamp 12 is driven by the light source driving circuit 11 and supplies light.

The light modulation unit 20 is configured to modulate the light from the lamp unit 10 (lamp 12) and includes a color separating system 21, a liquid crystal panel unit 22, and a color synthesizing system 23 (prism). The color separating system 21 separates the light emitted from the lamp unit 10 into RGB color lights and guides them to the corresponding liquid crystal panel units 22 (22*a* for R, 22*b* for G, and 22*c* for B). The liquid crystal panel units 22 modulate the lights for an image to be displayed and each includes a panel driving circuit 221 (221*a*, 221*b*, and 221*c*) and a liquid crystal panel 222 (222*a*, 222*b*, and 222*c*). The panel driving circuit 221 outputs a drive signal to the liquid crystal panel 222 according to an image signal IS for each of the RGB color lights output from the image processing engine 30. The liquid crystal panel 222 is driven by the panel driving circuit 221 and modulates each of the RGB color lights guided by the color separating system 21 to guide them to the color synthesizing system 23. The color synthesizing system 23 synthesizes the RGB color lights modulated by the liquid crystal panel unit 22, and the synthesized light is projected on the projection surface through a projection lens (not illustrated). Part of the light synthesized by the color synthesizing system 23 is guided to the light intensity sensor 40. In this manner, the color synthesizing system 23 is a light guide optical system that guides the part of the light to the light intensity sensor 40 and another part of the light to the projection surface.

The image processing engine 30 generates an image signal to be input to the light modulation unit 20. Specifically, the image processing engine 30 converts a video signal VS to the image signal IS according to the control signal from the correction circuit 50 and various setting values for changing the display state of the image, and outputs the converted image signal IS to the panel driving circuit 221. Examples of the video signal VS include various video signals such an HDMI (registered trademark) signal, a DVI signal, a RGB signal, and a component signal output from an image supply apparatus 100 (external apparatus) such as a personal computer, a DVD player, a VCR or a television tuner board. The various setting values are values for changing the display state of the image, such as brightness, contrast, γ (gamma), and a color adjustment. In the present embodiment, the image projection apparatus (projector 1) and the image supply apparatus that supplies image information (the video signal VS) to the projector 1 constitute an image display system.

The light intensity sensor 40 is disposed in the projector 1 to measure an intensity of the part of the light modulated by the light modulation unit 20 and includes a photodiode 41, an A/D convertor (ADC) 42, and a dimmer 43 (light reduction unit). The light intensity sensor 40 is installed at a position allowing measurement of the light from the lamp 12 modulated by the liquid crystal panel 222. The photodiode 41 outputs a voltage corresponding to the light guided thereto by the color synthesizing system 23 to the ADC 42. The ADC 42 converts the input voltage into a digital signal and output it to the correction circuit 50. The dimmer 43 is installed between the color synthesizing system 23 and the photodiode 41 to reduce the intensity of light entering the photodiode 41.

Such a configuration allows the light intensity sensor 40 to output a value (voltage) corresponding to the brightness (light intensity) of the image projected by the projector 1. In the present embodiment, the light intensity sensor 40 adjusts the intensity of light entering the photodiode 41 using the dimmer 43, but is not limited thereto. The dimmer 43 is not necessarily provided in a case where the photodiode 41 in the light intensity sensor 40 has a wide dynamic range. In addition, the light intensity sensor 40 is disposed to measure the light that is synthesized by the color synthesizing system 23 and is heading in a direction different from a direction of projection, but it is not limited to this configuration. The light intensity sensor 40 may be disposed in the direction of projection to measure the intensity of light, or may be disposed to measure the intensity of light at the projection surface. In this manner, the light intensity sensor 40 may be installed at an optional position as appropriate.

The correction circuit 50 is configured to correct (adjust) the brightness of the image projected on the projection surface based on the video signal VS (that is, the image signal IS output from the image processing engine 30) supplied to the projector 1 and a measurement result (a measured value, that is, an output value) of the light intensity sensor 40. More specifically, the correction circuit 50 includes a correction value setting circuit 53 that sets a correction value that can be set to each region in the image based on the video signal VS (image signal IS) and the measurement result of the light intensity sensor 40. The correction circuit 50 then corrects, using this correction value, the brightness of the image projected on the projection surface. The correction circuit 50 is capable of correcting the brightness of the image while the projector 1 projects the image as a moving image. Alternatively, the projector 1 may include a correction switch 60 (operation unit), and the correction circuit 50 may be configured to correct the brightness of the image based on an operation of the correction switch 60.

In the present embodiment, the correction circuit 50 includes a CPU 51, a memory 52 (storage unit), the correction value setting circuit 53 (setting unit), and an operation detecting circuit 54. The CPU 51 calculates, by a method described later, the correction value of the brightness of the image projected on the projection surface based on the output value of the light intensity sensor 40 and a value (content) stored in the memory 52. The CPU 51 then outputs a light intensity control signal (control signal) to the light source driving circuit 11 and the image processing engine 30 according to the correction value. In this manner, the correction circuit 50 outputs the control signal generated based on the correction value to the lamp unit 10 (the light source driving circuit 11) or the image processing engine 30, thereby correcting the brightness of the image projected on the projection surface. The correction circuit 50 preferably performs the correction based on the correction value to obtain an even luminance distribution of the image projected on the projection surface.

The CPU 51 preferably outputs, when a correction amount of the correction value of the output value (light intensity sensor value) of the light intensity sensor 40 per region of the display image changes, a correction value change signal to the correction value setting circuit 53 to exchange data therewith. Such a configuration allows the correction value setting circuit 53 of the correction circuit 50 to set the correction value based on information per region of the image and the measured value of the light intensity sensor 40. The correction value setting circuit 53 preferably changes the correction value, when a correlation between the information per region of the image and the measured value of the light intensity sensor 40 changes. The information per region of the image is, for example, image luminance of each region of the image for a test pattern, which will be described in detail later.

The memory 52 stores a test pattern, the correction value of the output value of the light intensity sensor 40 set per region of the display image, a method of calculating a predicted output value (predicted value) of the light intensity sensor 40, and the like, and exchanges data with the CPU 51. The correction value setting circuit 53 changes the correction value of the light intensity sensor value per region of the display image, which is stored in the memory 52, based on the correction value change signal from the CPU 51. The operation detecting circuit 54 outputs an input signal in accordance with an operation of an operation panel of the projector 1 or a remote control operation to the CPU 51.

Next, a method of correcting the brightness of the image by the correction circuit 50 will be described. In the present embodiment, the display image is divided into nine regions of 3×3, to each of which the correction value of the output value of the light intensity sensor 40 is set to correct the brightness of the image. The divided nine regions are referred to as regions A to I, respectively. The present embodiment is, however, not limited to this configuration in which the display image is divided into the nine regions of 3×3, and the display image may be divided into any other number of regions. In the present embodiment, a control on the light intensity starts on condition that, for example, the operation panel is operated by a user and the operation detecting circuit 54 outputs a light intensity control start signal to the CPU 51. When the user selects to start a light intensity control through the operation panel, the CPU 51 detects the light intensity control start signal from the operation detecting circuit 54, thereby starting the light intensity control.

FIGS. 2A to 2D are data tables stored in the memory 52 and used for correcting an image brightness. As illustrated in FIGS. 2A to 2D, the memory 52 stores the various data tables for correcting the image brightness. FIG. 2A illustrates a relation between test patterns for correcting the image brightness and the image luminance per region. In FIG. 2A, a test pattern for AF is an image to be projected when a function of automatically focusing on a projection screen of the projector 1 is performed. A test pattern for AK is an image to be projected when a function of correcting trapezoidal distortion occurring in the projected image of the projector 1 is performed. An image displayed in a termination sequence is an image to be projected when the projector 1 is terminated. In FIG. 2A, $BI_n$ (n=A to I) represents the image luminance (image brightness) for an image in each of the divided regions A to I.

FIG. 2B illustrates a relation between the image luminance BI and an output value OV of the light intensity sensor 40 and stores the output value OV of the light intensity sensor 40 at projection of an image having the image luminance BI. FIG. 2C illustrates the correction value of the output value of the light intensity sensor 40 set for each of the divided regions A to I. In FIG. 2C, $a_1$ to $i_1$ respectively represent the correction values $n_1$ of the output values of the light intensity sensor 40 set for the divided regions A to I. The correction value $n_1$ of the output value of the light intensity sensor 40 set per region is used for correcting a correlation between the projected image brightness (image luminance BI) that varies depending on the states of the lamp unit 10 and the light modulation unit 20 and the output value OV of the light intensity sensor 40. The correction value $n_1$ can be changed by a method described later. FIG. 2D illustrates a relation between the correction value Bri of the image brightness calculated by a method described later from a predicted output value PSV (predicted value) of the light intensity sensor 40 and an output value SV (measured value) of the light intensity sensor 40, and the amount of change in a supplied electrical power to the lamp 12. In FIG. 2D, $cPow_n$ represents the amount of change in the supplied electrical power to the lamp 12 for n=Bri.

Figures 3, 4:
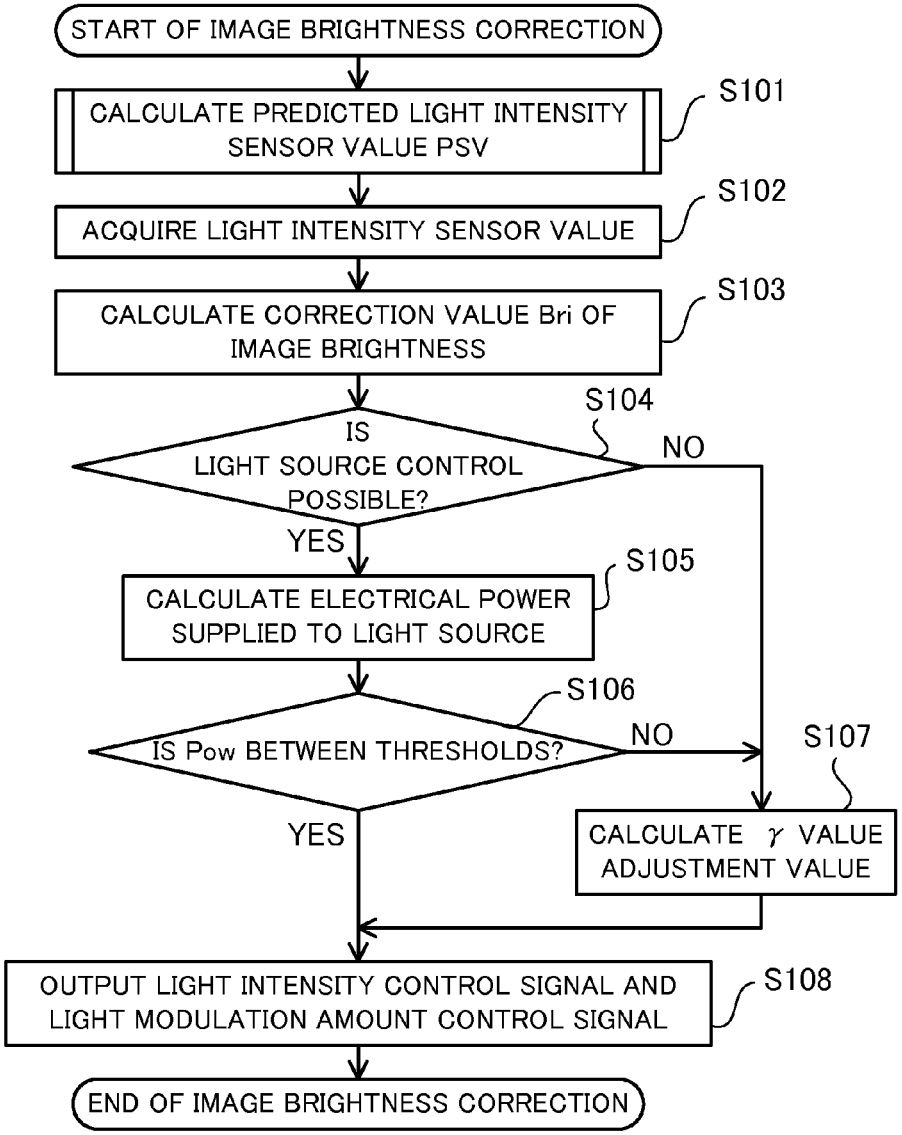
FIG. 3 is a data table for the image brightness correction stored in an image processing engine in the first embodiment.
FIG. 4 is a flowchart of a method of correcting brightness of an image projected on a projection surface in the first embodiment.

FIG. 3 is a data table for correcting the image brightness stored in the image processing engine 30. As illustrated in FIG. 3, the image processing engine 30 stores the data table for correcting the image brightness. In the present embodiment, this data table stores a relation between the correction value Bri of the image brightness and $c\gamma_n$ that represents a γ value change amount. In FIG. 3, $c\gamma_n$ represents the γ value change amount set to the liquid crystal panel 222 with n=Bri.

FIG. 4 is a flowchart of the method of correcting the brightness of the image projected on the projection surface in the present embodiment. Steps in FIG. 4 are each performed mainly based on a command (instruction) from the CPU 51. First at step S101, the CPU 51 displays a test pattern set in the memory 52 and calculates the predicted value PSV of the light intensity sensor 40 corresponding to the test pattern. The flow at step S101 will be described in detail later.

Subsequently at step S102, the light intensity sensor 40 measures the light intensity at displaying of the test pattern at step S101 and outputs a measured value (output value) to the CPU 51. Then, at step S103, the CPU 51 calculates the correction value Bri of the image brightness based on the predicted output value PSV of the light intensity sensor 40 calculated at step S101 and the output value of the light intensity sensor 40 measured at step S102.

Subsequently at step S104, the CPU 51 determines whether a light source control is possible for the correction value Bri of the brightness of the image projected on the projection surface, which is calculated at step S103. When the light source control is possible, the flow proceeds to step S105. On the other hand, the light source control is impossible, the CPU 51 outputs the correction value Bri of the image brightness to the image processing engine 30, and the flow proceeds to step S107. The light source control is impossible, for example, in a case where the supplied electrical power to the lamp 12 is 100% when the light intensity of the lamp needs to be increased, or in a case where the supplied electrical power to the lamp 12 is set to a lower limit when the light intensity of the lamp needs to be decreased.

At step S105, the CPU 51 calculates, based on the data table of FIG. 2D set in the memory 52, the change amount $cPow_n$ of the supplied electrical power to the lamp 12 corresponding to the correction value Bri of the image brightness calculated at step S103. The change amount $cPow_n$ of the supplied electrical power to the lamp 12 is an adjustment value of a driving electrical power of the lamp 12. Using a currently set electrical power value sPow and the change amount $cPow_n$ of the supplied electrical power, the CPU 51 calculates an electrical power Pow supplied to the lamp 12 (light source) based on the following expression (1).

$$Pow=sPow+cPow_n \tag{1}$$

Subsequently at step S106, the CPU 51 determines whether the electrical power Pow supplied to the lamp 12 calculated at step S105 is between the upper limit and the lower limit previously set in the memory 52 (that is, within a range of the predetermined thresholds). When $Pow_{max}$ and $Pow_{min}$ respectively represent the upper and lower limits of the electrical power supplied to the lamp 12, the CPU 51 determines whether the electrical power Pow is between the upper limit and the lower limit inclusive as represented in the following expression (2).

$$Pow_{min} \leq Pow \leq Pow_{max} \tag{2}$$

When satisfying expression (2), the electrical power Pow supplied to the lamp 12 calculated at step S105 is between the upper limit $Pow_{max}$ and the lower limit $Pow_{min}$ inclusive. Thus, at step S108, the CPU 51 sets the electrical power supplied to the lamp 12 to be the electrical power Pow calculated at step S105. On the other hand, when not satisfying expression (2), the electrical power supplied to the lamp 12 calculated at step S105 is not between the upper limit and the lower limit inclusive, and thus the following processing is performed. First, the CPU 51 calculates the correction value Bri of the image brightness that has failed to be corrected with the light source intensity, using expression (3).

$$\begin{cases} Bri = Bri(Pow) - Bri(Pow_{max}) & (Pow_{max} < Pow) \\ Bri = Bri(Pow) - Bri(Pow_{min}) & (Pow < Pow_{min}) \end{cases} \tag{3}$$

Then, the CPU 51 outputs the correction value Bri of the image brightness to the image processing engine 30. Next, the CPU 51 sets the electrical power Pow supplied to the lamp 12, as represented by the following Expression (4), and the flow proceeds to step S107.

$$\begin{cases} Pow = Pow_{max} & (Pow_{max} < Pow) \\ Pow = Pow_{min} & (Pow < Pow_{min}) \end{cases} \tag{4}$$

At step S107, based on the data table illustrated in FIG. 3, the image processing engine 30 first calculates the γ value change amount $c\gamma_n$ to be set to the liquid crystal panel 222 corresponding to the correction value Bri input from the CPU 51 at step S104 or step S106. Next, based on a currently set γ value sγ and the γ value change amount $c\gamma_n$, the image processing engine 30 determines a γ value (gamma value) to be set to the liquid crystal panel 222.

Subsequently at step S108, the CPU 51 first outputs the light intensity control signal corresponding to the electrical power Pow supplied to the lamp 12, which is determined at step S106, to the light source driving circuit 11. The light source driving circuit 11 then controls the supplied electrical power to the lamp unit 10 based on the light intensity control signal for the lamp 12, thereby adjusting the brightness of the image projected on the projection surface. Next, the image processing engine 30 outputs a light modulation amount control signal for the liquid crystal panel 222 corresponding to the γ value to be set to the liquid crystal panel 222, which is determined at step S107, to the panel driving circuit 221. Then, the panel driving circuit 221 changes the set γ value based on the light modulation amount control signal for the liquid crystal panel 222, thereby adjusting the brightness of the image projected on the projection surface. In the present embodiment, the timing of changing the supplied electrical power to the lamp unit 10 preferably coincides with the timing of changing the light modulation amount of the liquid crystal panel 222.

The above described method of changing the image brightness allows a correction of the brightness change of the projected image attributable to a change in the state of the projector 1 by controlling the light source intensity and the light modulation amount. At steps S101 to S108, the control of the light source intensity is prioritized over the control of the light modulation amount, but the control of the light modulation amount may be prioritized. Alternatively, the correction may be controlled through only one of the control of the light source intensity and the control of the light modulation amount. Moreover, the present embodiment may be modified as appropriate such that the light intensity is controlled by controlling a shutter or an iris, for example.

Figure 5:
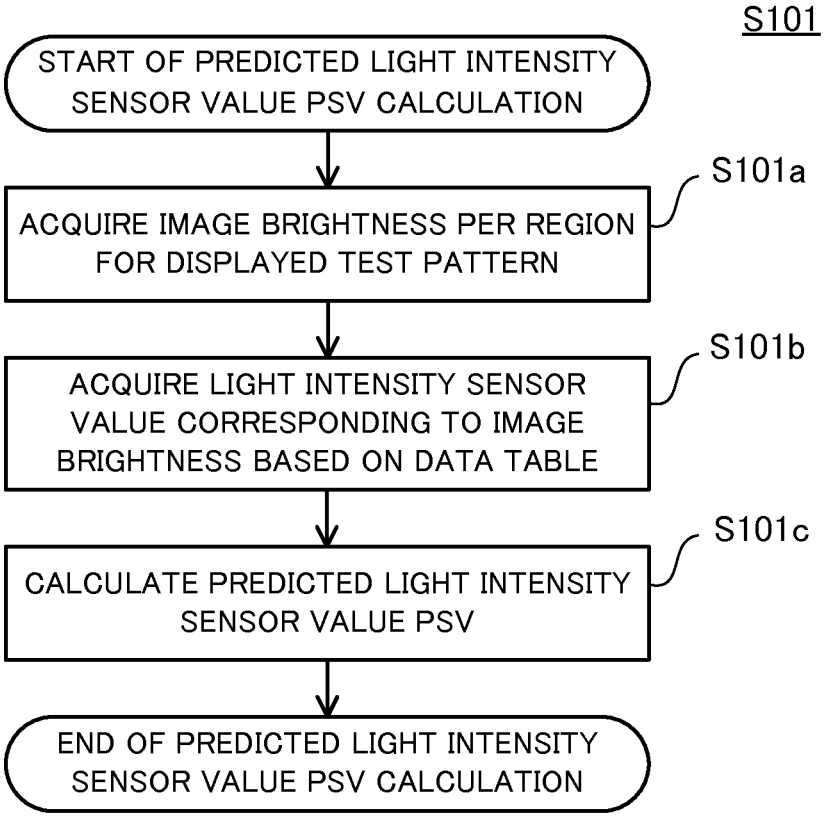
FIG. 5 is a flowchart of a method of acquiring a predicted value of a light intensity sensor in the first embodiment.

Next, referring to FIG. 5, the method of calculating the predicted value PSV of the light intensity sensor at step S101 in FIG. 4 will be described in detail. FIG. 5 is a flowchart of the method of calculating the predicted value PSV of the light intensity sensor. Steps in FIG. 5 are each performed mainly based on a command (instruction) from the CPU 51.

First at step S101*a*, the CPU 51 recognizes a displayed test pattern and acquires image luminance information $BI_N$ per region for the displayed test pattern based on the data table illustrated in FIG. 2A. Subsequently at step S101*b*, the CPU 51 acquires the light intensity sensor value, which is the output value $OV_N$ (N=A to I) of the light intensity sensor 40, corresponding to the image luminance per region. The output value $OV_N$ (the light intensity sensor value) of the light intensity sensor 40 is acquired based on the image luminance information $BI_N$ per region of the test pattern acquired at step S101*a* and the data table illustrated in FIG. 2B.

Subsequently at step S101*c*, the predicted value PSV of the light intensity sensor 40 is calculated as a product sum of the output value $OV_N$ of the light intensity sensor 40 acquired at step S101*b* and the correction value of the output value of the light intensity sensor 40 illustrated in FIG. 2C. The predicted output value PSV of the light intensity sensor 40 calculated through the above steps S101*a* to S101*c* is represented by the following Expression (5).

$$\begin{aligned} PSV=&OV(BI_A)\times a_1+OV(BI_B)\times b_1+OV(BI_C)\times c_1+\\ &OV(BI_D)\times d_1+OV(BI_E)\times e_1+OV(BI_F)\times f_1+\\ &OV(BI_G)\times g_1+OV(BI_H)\times h_1+OV(BI_I)\times i_1 \end{aligned} \tag{5}$$

As described above, the CPU 51 calculates the predicted value PSV of the light intensity sensor 40 based on the flowcharts illustrated in FIGS. 4 and 5. In the present embodiment, the data tables in FIGS. 2A to 2C are preferably stored as data (the correction value) corresponding to three luminance values for the colors of R, G, and B independently in the memory 52.

In the present embodiment, the predicted value PSV of the light intensity sensor 40 is calculated based on the image luminance per region for the test pattern, but is not limited thereto. For example, the calculation may be based on an average luminance per region or a histogram. The predicted value PSV of the light intensity sensor 40 is calculated in the procedure from steps S101*a* to S101*c*, but is not limited to this procedure. For example, a result of the calculation at steps S101*a* to S101*c* may be stored as data illustrated in FIG. 2A in the memory 52 in advance, and a calculation result corresponding to the test pattern may be read out at step S101.

Next, a control method of making even the brightness of the image projected on the projection surface when a correlation between the output value of the light intensity sensor 40 and the brightness of the projected image changes will be described. The correlation between the output value of the light intensity sensor 40 and the brightness of the projected image changes when, for example, components constituting the projector 1 changes because of aging. In the present embodiment, when changed, this correlation between the output value of the light intensity sensor 40 and the brightness of the projected image is corrected (changed) by changing the correction value of the output value of the light intensity sensor 40 per image region illustrated in FIG. 2C.

Figure 6:
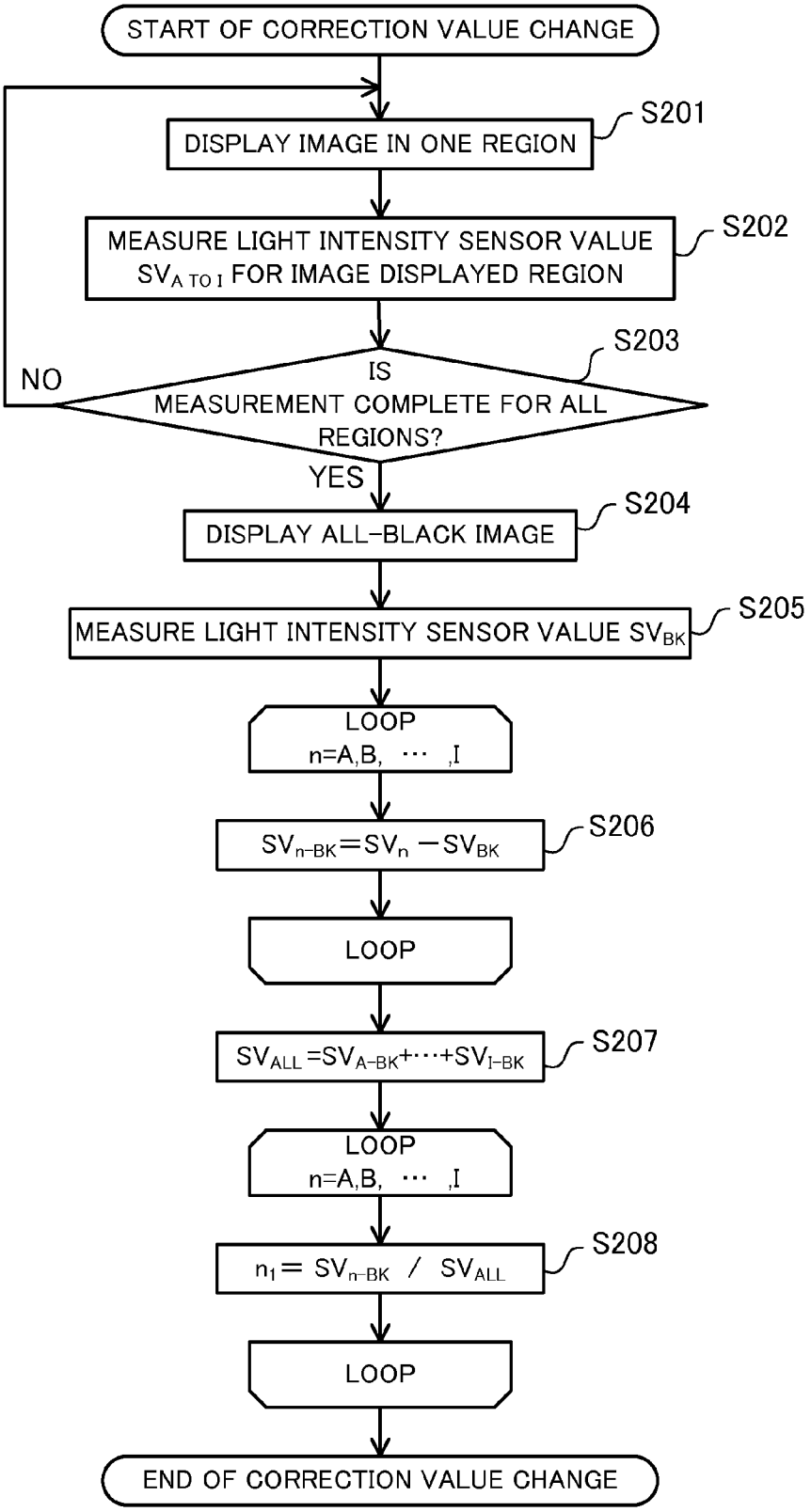
FIG. 6 is a flowchart of a method of changing a correction value in the first embodiment.
Figure 7A:
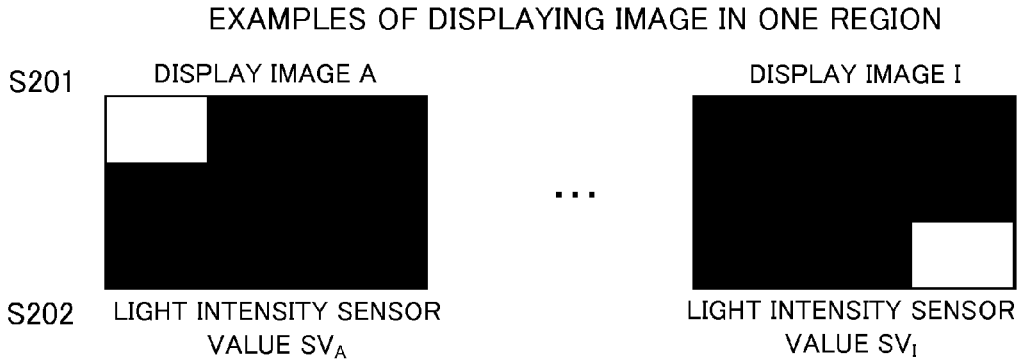
FIGS. 7A to 7C are schematic diagrams illustrating specific examples of the method of changing the correction value in the first embodiment.
Figure 7B:
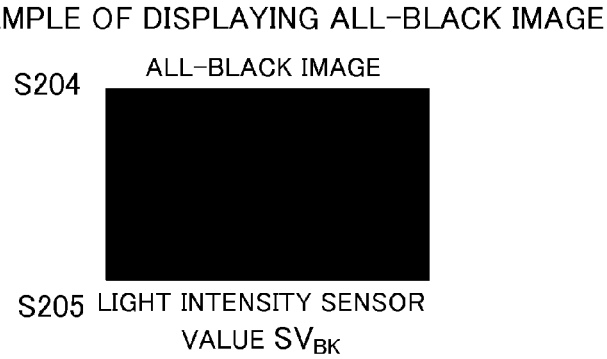
Figure 7C:
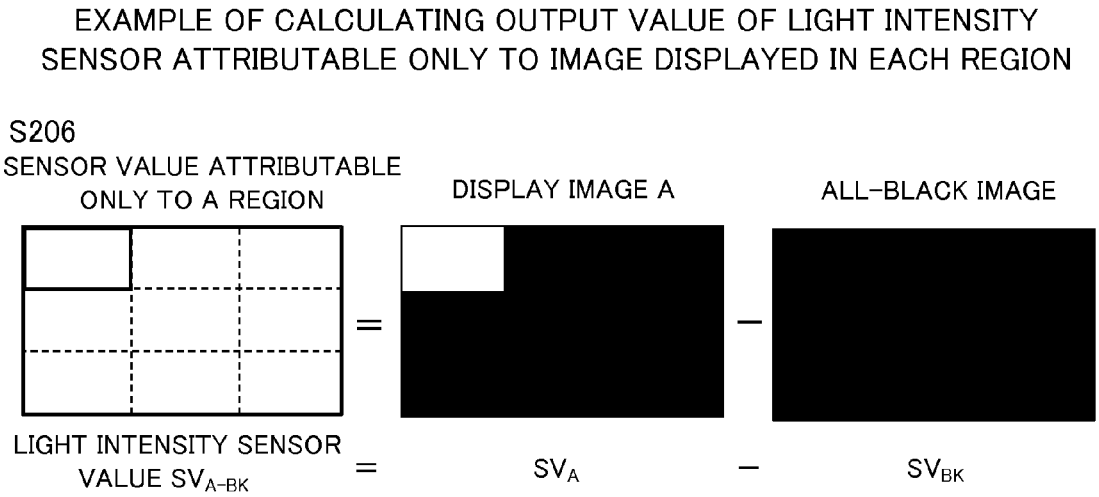

Referring to FIGS. 6 and 7A to 7C, a method of changing the correction value of the output value of the light intensity sensor 40 set per region of the display image in the present embodiment will be described. FIG. 6 is a flowchart of the method of changing the correction value. Steps in FIG. 6 are each performed mainly based on a command (instruction) from the correction circuit 50 (CPU 51). FIGS. 7A to 7C are schematic diagrams illustrating specific examples of the method of changing the correction value. FIG. 7A illustrates a correspondence relation between a display example of an image only displaying a region of the image at step S201 in FIG. 6 and the output value of the light intensity sensor 40 measured at step S202. FIG. 7B illustrates a correspondence relation between a display example of an all-black image displayed at step S204 and the output value of the light intensity sensor 40 measured at step S205. The all-black image is an image in which the luminance value is 0% for all pixels. In contrast, an all-white image is an image in which the luminance value is 100% for all pixels. FIG. 7C is a diagram illustrating a calculation example of the output value of the light intensity sensor 40 attributable only to an image displayed in a region, which is calculated at step S206.

In the present embodiment, the process of changing the correction value starts on condition that, for example, the operation panel is operated by the user and the operation detecting circuit 54 outputs a correction value change start signal to the CPU 51. When the process of changing the correction value is selected through the operation panel by the user, the CPU 51 detects the correction value change start signal from the operation detecting circuit 54 and outputs the correction value change signal to the correction value setting circuit 53, thereby starting the process of changing the correction value.

When the process of changing the correction value of the output value of the light intensity sensor 40 starts, the display images A to I illustrated in FIG. 7A are first displayed at step S201 in FIG. 6. For example, the display image A is an image in which, among the regions dividing the display image in 3×3, a selected region A is all white and the other regions are all black. Subsequently at step S202, the CPU 51 measures the output value of the light intensity sensor 40 at each time of displaying an image in which an all-white image is displayed in region N at step S201 and sets the measured value (first value) to be $SV_N$ (N=A to I). In this manner, the CPU 51 acquires a plurality of first values each measured by the light intensity sensor 40 per region of the image while a predetermined image is displayed per region of the image.

Then, at step S203, the CPU 51 determines whether all the output values (first values) of the light intensity sensor 40 $SV_N$ corresponding to the respective display images A to I are measured. When not all the output values are measured, the flow returns to step S201 and repeats steps S201 to S203. On the other hand, when all the output values are measured, the flow proceeds to step S204.

At step S204, the CPU 51 (image processing engine 30) displays an all-black image illustrated in FIG. 7B. Subsequently at step S205, the CPU 51 measures the output value of the light intensity sensor 40 for the all-black image displayed at step S204 and sets the output value (a second value) to be $SV_{BK}$. In this manner, the CPU 51 acquires the second value measured by the light intensity sensor 40 while the black image (all-black image) is displayed.

Subsequently at step S206, the CPU 51 calculates the output value $SV_{N\text{-}BK}$ of the light intensity sensor 40 attributable only to an image displayed per region, as illustrated in FIG. 7C. Here, N represents any of the divided regions A to I. For example, the output value $SV_{A\text{-}BK}$ (a third value) of the light intensity sensor 40 attributable only to an image displayed in region A is calculated by the following expression (6).

$$SV_{A\text{-}BK}=SV_A-SV_{BK} \tag{6}$$

In this manner, the CPU 51 subtracts the output values $SV_{BK}$ (second values) from the respective output values $SV_N$ (first values), thereby calculating the respective output values $SV_{N\text{-}BK}$ (third values).

Subsequently at step S207, the CPU 51 calculates the output value $SV_{ALL}$ (a fourth value) of the light intensity sensor 40 attributable only to a displayed image. The output value $SV_{ALL}$ can be calculated, for example, by the following expression (7).

$$SV_{ALL}=SV_{A\text{-}BK}+SV_{B\text{-}BK}+\ldots+SV_{I\text{-}BK} \tag{7}$$

In this manner, the CPU 51 calculates the fourth value as a sum of the output values $SV_{N\text{-}BK}$ (third values).

Subsequently at step S208, the CPU 51 calculates to set the correction value $n_1$ of the output value of the light intensity sensor 40 that is illustrated in FIG. 2C and set in the memory 52, using the following expression (8).

$$n_1=SV_{N\text{-}BK}/SV_{ALL} \tag{8}$$

In this manner, the CPU 51 calculates the correction value by dividing the output values $SV_{N\text{-}BK}$ (third values) by the respective output values $SV_{ALL}$ (fourth values).

The process of the flowchart in FIG. 6 allows the correction value per region of the display image to be maintained as appropriate at low cost when the correlation between any component of the projector 1 and the brightness of the image projected on the projection surface changes and the correlation between the output value of the light intensity sensor 40 and the correction value per region of the display image changes.

In the present embodiment, the correction value change starts on condition that the operation panel is operated by the user, but may start on other conditions. For example, the correction value may be changed on condition that the projector 1 is turned on for the first time after having any of its constituting components replaced or that a certain period of time has passed. Furthermore, the image displayed in a region selected at step S201 is all white, but is not limited to this configuration. For example, any image such as an RGB solid image or a test pattern for controlling the light intensity may be used. In addition, in the calculation of the output value of the light intensity sensor 40 attributable only to an image displayed in any of the regions, the subtraction is made between the image in which an image is displayed in the region as displayed at step S201 and the all-black image used at step S204, but is not limited to those images. For example, images may be displayed in a plurality of regions in the image displayed at step S201, or an all-white image or any other image may be used at step S204.

As described above, when changed due to aging for example, the correlation between the output value of the light intensity sensor 40 and the brightness of the projected image can be corrected by changing the correction value of the output value of the light intensity sensor 40 set per region of the display image, thereby maintaining the brightness of the projected image at the brightness of the image before the aging. In this manner, the present embodiment allows the brightness of the projected image to be maintained even or constant at reduced cost for the sensor when the correlation between the output value of the light intensity sensor and the brightness of the projected image has changed. The present embodiment thus provides the image projection apparatus and the image display system that are capable of highly accurately adjusting to an optional projection light intensity at low cost.

In the present embodiment, the display image is divided into the 3×3 rectangles (nine regions), but is not limited to this division. For example, the image may be divided into any number of regions such as 16 regions of 4×4, or into regions of any shapes instead of regions having an equal area.

In the present embodiment, the light source intensity is controlled (controllable) by adjusting an electrical power supplied to one lamp unit, but is not limited to this configuration. For example, the light source intensity may be controlled with a plurality of light sources whose light intensities are each controlled, or may be controlled with an LED or an LD whose duty ratio is controlled. In the present embodiment, the light modulation amount is controlled by adjusting the γ value. In other words, the image processing engine 30 corrects (adjusts) the brightness of the image by multiplying a gradation value included in the image signal IS by a correction coefficient based on a command from the correction circuit 50 (the CPU 51). The present embodiment is not, however, limited to this configuration. For example, the image processing engine 30 may correct (adjust) the brightness of the image by offsetting the gradation value included in the image signal IS based on a command from the correction circuit 50. Alternatively, the light modulation amount may be controlled by using both of the techniques. The brightness of the projected image can be maintained even or constant with a configuration in which the output signal of each of the photodiode 41 plurally disposed is output to the correction circuit 50, or with a configuration including a CCD sensor or a CMOS sensor.

Second Embodiment

Next, referring to FIGS. 8 to 13, an image projection apparatus (projector 2) in a second embodiment of the present invention will be described. The present embodiment allows correction of luminance/chromaticity unevenness generated in the projected image, with a simple configuration.

Figure 8:
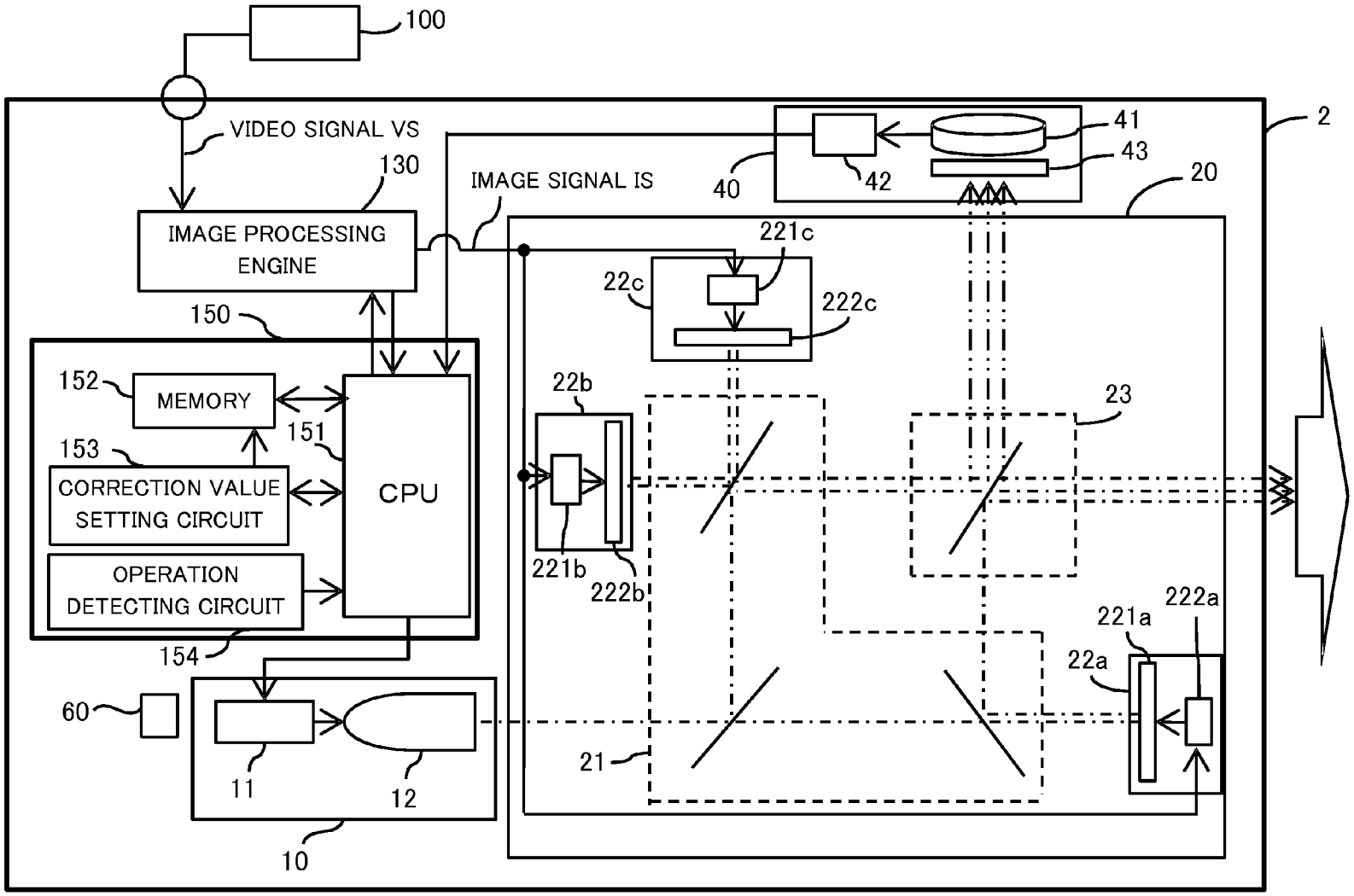
FIG. 8 is a schematic configuration diagram of an image projection apparatus in a second embodiment.
Figure 9A:
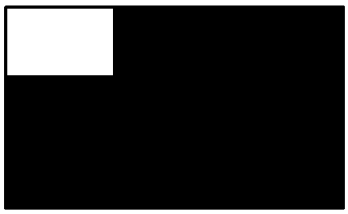
FIGS. 9A to 9I are examples of a test pattern in the second embodiment.
Figure 9B:
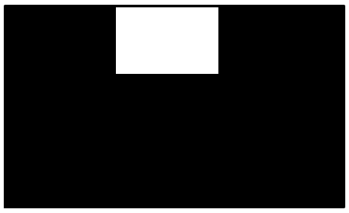
Figure 9C:
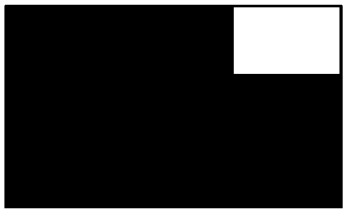
Figure 9D:
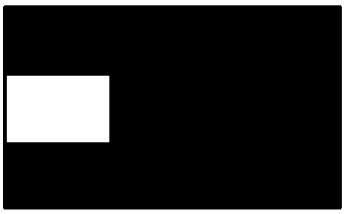
Figure 9E:
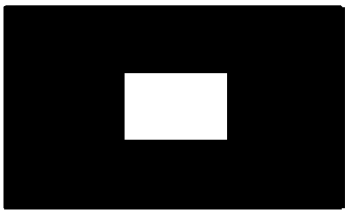
Figure 9F:
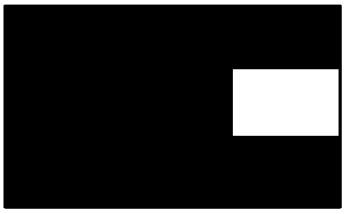
Figure 9G:
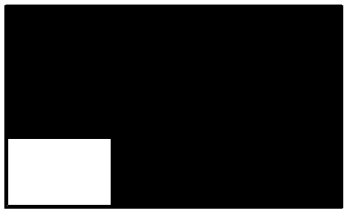
Figure 9H:
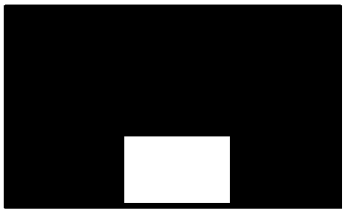
Figure 9I:
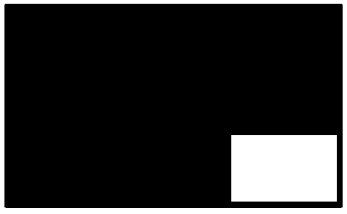

FIG. 8 is a schematic configuration diagram of the image projection apparatus in the present embodiment. In FIG. 8, the same elements as those in the first embodiment (FIG. 1) will be denoted by the same reference numerals and the duplicate descriptions thereof will be omitted. An image processing engine 130 (image processing unit) of the projector 2 in the present embodiment is capable of adjusting color per region of the image. As described later, a correction circuit 150 is capable of correcting the luminance unevenness or chromaticity unevenness (luminance/chromaticity unevenness) of the image based on the measured value of the light intensity sensor 40 and a correction value $Ue_n$ (second correction value). The projector 2 and the projector 1 are different from each other in that the projector 2 includes the image processing engine 130 and the correction circuit 150 in place of the image processing engine 30 and the correction circuit 50, respectively, and are the same for the other components.

The image processing engine 130 is capable of changing the γ value per image region in addition to the function of the image processing engine 30 in the first embodiment. The image processing engine 130 is capable of displaying a test pattern for correcting the luminance/chromaticity unevenness based on a signal output from the correction circuit 150. The correction circuit 150 includes a CPU 151, a memory 152, a correction value setting circuit 153, and an operation detecting circuit 154. The CPU 151 outputs a test pattern display signal and an unevenness correction signal to the image processing engine 130 in addition to the function of the CPU 51 in the first embodiment.

Subsequently, referring to FIGS. 9A to 9I, the test pattern for correcting the luminance/chromaticity unevenness will be described. FIGS. 9A to 9I are diagrams illustrating examples of the test pattern in the present embodiment. The test patterns for correcting the luminance/chromaticity unevenness (the test patterns A to I in FIGS. 9A to 9I) are a plurality of display images in each of which an image is displayed in one of a plurality of regions dividing the display image. In the present embodiment, as in the first embodiment, the correction is performed with nine regions of 3×3 dividing the display image. The divided nine regions are referred to as regions A to I, respectively. The image displayed in any of the divided regions is a solid image in R, G, or B. The present embodiment is, however, not limited to this configuration.

FIGS. 10A to 10C are data tables for correcting the luminance/chromaticity unevenness that are stored in the memory 152 in the present embodiment. FIG. 10A is the data table illustrating a relation between the test pattern for correcting the luminance/chromaticity unevenness and the image luminance per region. In FIG. 10A, a test pattern $N_c$ represents a test pattern displaying color c in region N with N=A to I and c=R, G, or B. FIG. 10B is the data table storing a correlation between the image luminance set for each combination of R, G, and B and the output value of the light intensity sensor 40. FIG. 10C is the data table illustrating the correction value of the output value of the light intensity sensor 40 set for each of the divided regions A to I. In FIG. 10C, $a_2$ to $i_2$ represent the correction values of the output values of the light intensity sensor 40 set for the respective divided regions A to I, and are set in advance by the correction value setting circuit 153 using the method of correcting the correction value in the first embodiment.

Figures 11, 12:
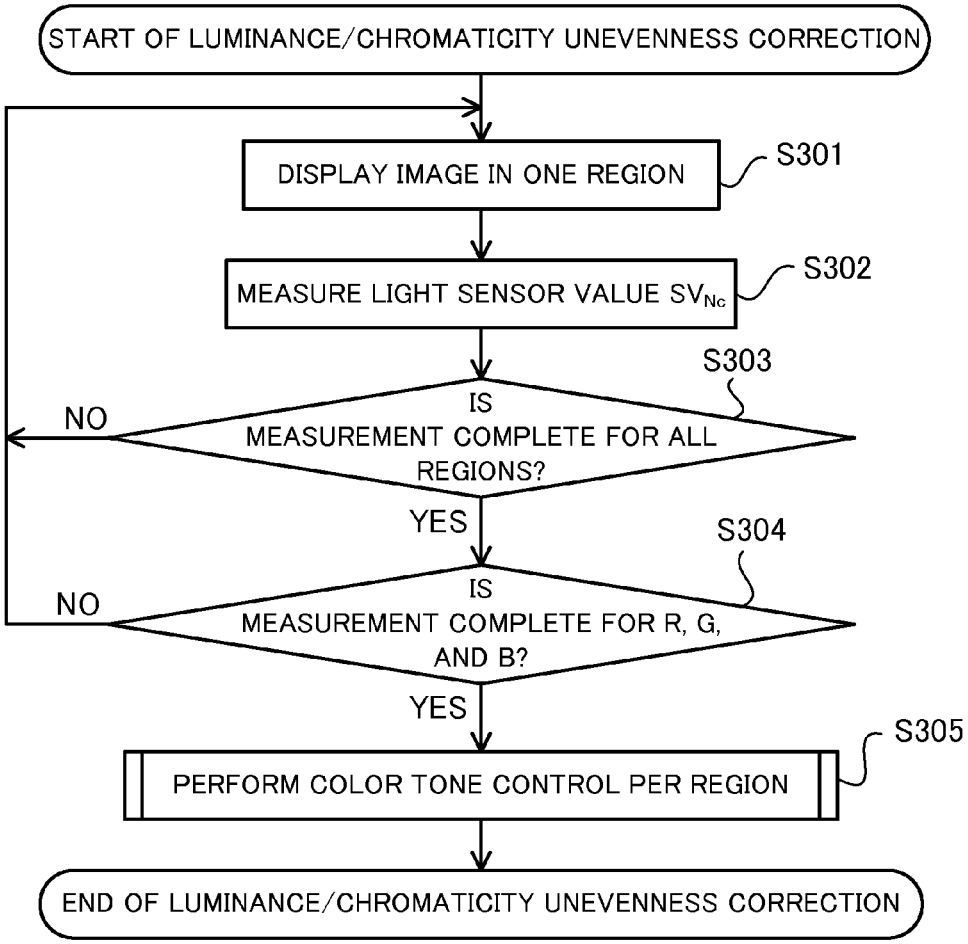
FIG. 11 is a data table for the luminance/chromaticity unevenness correction stored in an image processing engine in the second embodiment.
FIG. 12 is a flowchart of the luminance/chromaticity unevenness correction method in the second embodiment.

The image processing engine 130 stores various data tables for correcting the luminance/chromaticity unevenness. FIG. 11 is a data table for correcting the luminance/chromaticity unevenness stored in the image processing engine 130.

In the present embodiment, the correction of the luminance/chromaticity unevenness starts on the same condition for starting the light intensity control in the first embodiment, but that condition may be changed as appropriate such that the correction starts when, for example, components constituting the projector 2 are replaced. In the present embodiment, the method of displaying the test pattern is such that the image processing engine 130 receives the test pattern display signal from the CPU 151 and outputs the image signal of the test pattern to the panel driving circuit 221 to display the test pattern, but is not limited to this configuration. The method may be changed as appropriate such that, for example, the CPU 151 outputs the image signal to the panel driving circuit 221 to display the test pattern.

Figure 13:
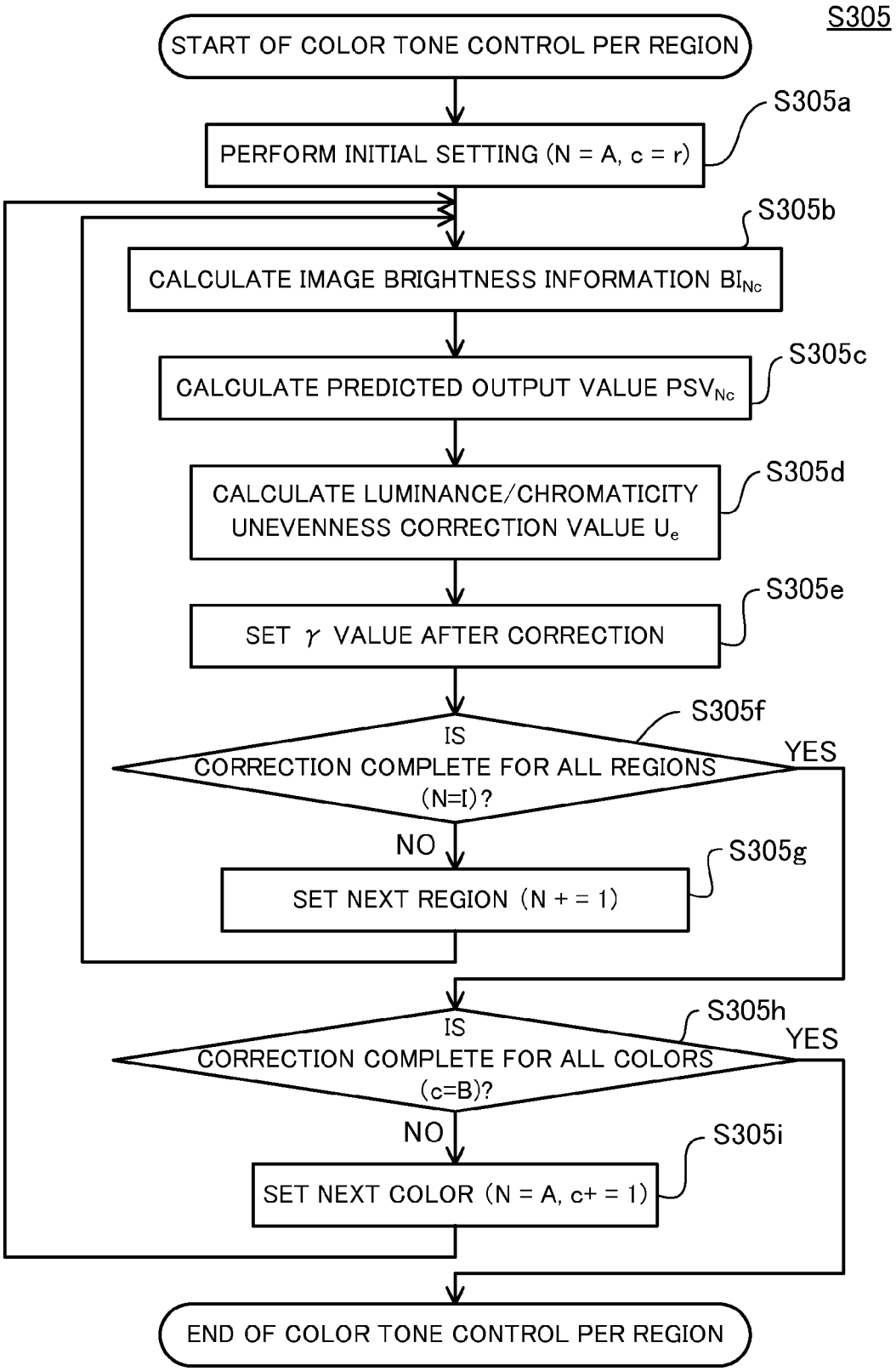
FIG. 13 is a flowchart of a color tone control per region in the second embodiment.

Next, referring to FIGS. 12 and 13, the procedure of the unevenness correction will be described. FIG. 12 is a flowchart of the method of correcting the luminance/chromaticity unevenness in the present embodiment. Steps in FIG. 12 are each performed mainly based on a command from the CPU 151.

First at step S301, the CPU 151 (image processing engine 130) displays the test pattern in the following procedure. The CPU 151 first outputs the test pattern display signal for displaying the test pattern $N_c$ stored as illustrated in FIG. 10A to the image processing engine 130. The image processing engine 130 outputs the image signal IS to the panel driving circuit 221 according to the test pattern display signal from the CPU 151 and the test pattern is displayed.

Subsequently at step S302, the light intensity sensor 40 measures the output value of the light intensity sensor 40 corresponding to the test pattern displayed at step S301. The measured value is represented by $SV_{Nc}$ (N=A to I, c=R, G, B). Then, at step S303, the CPU 151 determines whether the output value of the light intensity sensor 40 has been measured for all the regions A to I. When the output value of the light intensity sensor 40 has been measured not for all the regions, the flow returns to step S301 and repeats steps S301 to S303. On the other hand, when the output value of the light intensity sensor 40 has been measured for all the regions, the flow proceeds to step S304.

At step S304, the CPU 151 determines whether the output value of the light intensity sensor 40 has been measured for all the colors of R, G, and B to be displayed in the regions. When the output value of the light intensity sensor 40 has been measured not for all the colors, the flow returns to step S301. On the other hand, when the output value of the light intensity sensor 40 has been measured for all the colors, the flow proceeds to step S305. Subsequently at step S305, the CPU 151 performs a correction by a method described later so that the brightness is substantially even for the regions A to I. The state of being substantially even is not limited to the state of being strictly even but includes the state of being even in effective. In this manner, the luminance/chromaticity unevenness correction is preformed in accordance with the flowchart in FIG. 12.

Next, referring to FIG. 13, a method (step S305 in FIG. 12) of performing a color tone control so that the brightness is substantially even for the regions (regions A to I) will be described. FIG. 13 is a flowchart of the color tone control per region. Steps in FIG. 13 are each performed mainly based on a command from the CPU 151.

First at step S305*a*, the CPU 151 performs an initial setting of region N and color c subject to the color tone control. In the present embodiment, the initially set values are N=A and c=R. Subsequently at step S305*b*, the CPU 151 calculates image luminance information $BI_{Nc}$ per region for the displayed test pattern based on the data table in FIG. 10A, which stored in the memory 152. For the image luminance per region that is not stored, the values of R, G, and B are all set to 0. This means that, in a case of the test pattern $A_R$ for example, the corresponding image luminance information $BI_{Nc}$ per region is such that $BI_{AR}$=(100, 0, 0), $BI_{BR}$=$BI_{CR}$=, . . . , =$BI_{IR}$=(0, 0, 0). In this manner, the CPU 151 acquires the image luminance information $BI_{Nc}$ per region of the display image while a predetermined image (for example, the test pattern) is displayed per region of the display image.

Subsequently at step S305*c*, the CPU 151 calculates a predicted output value $PSV_{Nc}$ of the light intensity sensor 40 at displaying of each of the test patterns. The predicted output value $PSV_{Nc}$ is calculated based on the image luminance information $BI_{Nc}$ per region acquired at step S305*b*, the output value $OV_{Nc}$ of the light intensity sensor in FIG. 10B, and the correction value $n_2$ of the output value of the light intensity sensor 40 per region of the display image in FIG. 10C. The predicted output value $PSV_{Nc}$ of the light intensity sensor 40 at displaying of each of the test patterns is expressed in the following expression (9).

$$PSV_{Nc}=OV_C(BI_{Ac})\times a_2+OV_C(BI_{Bc})\times b_2+OV_C(BI_{Cc})\times c_2+OV_C(BI_{Dc})\times d_2+OV_C(BI_{Ec})\times e_2+OV_C(BI_{Fc})\times f_2+OV_C(BI_{Gc})\times g_2+OV_C(BI_{Hc})\times h_2+OV_C(BI_{Ic})\times i_2 \quad (9)$$

In this manner, the CPU 151 calculates the predicted output value $PSV_{Nc}$ of the light intensity sensor 40 based on the image luminance information $BI_{Nc}$ and the correction value $n_2$.

Subsequently at step S305*d*, the CPU 151 calculates the correction value $Ue_n$ (second correction value) for luminance/chromaticity unevenness. The correction value $Ue_n$ is calculated based on the predicted output value $PSV_{Nc}$ of the light intensity sensor 40 at displaying of each of the test patterns, which is calculated at step S305*c*, and the output value of the light intensity sensor 40 $SV_{Nc}$ measured at step S302. The correction value $Ue_n$ for luminance/chromaticity unevenness is expressed in the following expression (10).

$$Ue_n=PSV_{Nc}-SV_{Nc} \quad (10)$$

In this manner, the CPU 151 calculates the correction value $Ue_n$ (second correction value) for correcting the luminance/chromaticity unevenness based on the output value of the light intensity sensor 40 $SV_{Nc}$ and the predicted output value $PSV_{Nc}$.

Subsequently at step S305*e*, the CPU 151 acquires, based on the data table illustrated in FIG. 11, the γ value change amount $c\gamma_{Cn}$ to be set per region of the liquid crystal panel 222 and for each color, corresponding to the correction value $Ue_n$ (second correction value) for luminance/chromaticity unevenness calculated at step S305*d*. The CPU 151 determines the γ value $\gamma_{Nc}$ set to the liquid crystal panel 222 based on the currently set γ value $s\gamma_{Nc}$ and the γ value change amount $c\gamma_{Cn}$. In this manner, the CPU 151 changes the γ value per region of the image based on the correction value $Ue_n$ (second correction value) for luminance/chromaticity unevenness.

Subsequently at step S305*f*, the CPU 151 determines whether the correction is complete for all the regions. When the correction is complete not for all the regions, the flow proceeds to step S305*g*. On the other hand, when the correction is complete for all the regions, the flow proceeds to step S305*h*. At step S305*g*, the CPU 151 sets region N subject to the correction as a region to be corrected next and returns to step S305*b*. In the present embodiment, region N subject to the correction changes in order of A, B, C, . . . , I.

At step S305*h*, the CPU 151 determines whether the correction is complete for all the colors. When the correction is complete not for all the colors, the flow proceeds to step S305*i*. On the other hand, when the correction is complete for all the colors, the flow terminates. At step S305*i*, the CPU 151 sets region N subject to the correction to be the region A and sets color c subject to the correction to be a color to be corrected next. Then the flow returns to step S305*b* and repeats the correction for all the regions. In the present embodiment, color c subject to the correction changes in order of R, G, and B. As described above, in the present embodiment, when the luminance/chromaticity unevenness is generated in the projected image, the γ value can be set to an appropriate value per region.

In the present embodiment, the luminance/chromaticity unevenness correction is performed by changing the γ value set per region, but is not limited thereto. The light source intensity may be controlled by controlling the supplied electrical power or duty ratio of each of a plurality of light sources (lamp 12) corresponding to the respective regions. Alternatively, the light source control and the color tone control may be both performed, for example, and other configurations may be applied as appropriate. For example, after the luminance/chromaticity unevenness correction is performed, the correction value of the output value of the light intensity sensor 40 set per region of the display image may be corrected to correct change in the correction value due to the luminance/chromaticity unevenness.

The control as described above allows provision of the image projection apparatus capable of highly accurately correcting, with a simple configuration (at low cost), the luminance/chromaticity unevenness generated in the projected image. The image displayed in one region at step S301 is a solid image of R, G, or B, but is not limited thereto. The image may be changed as appropriate to any image that allows acquisition of a correlation between the image displayed in the region and the output value of the light intensity sensor 40. Alternatively, the correction may be based on a correlation between the configuration of displaying images in a plurality of regions, instead of displaying only in one region, and the output value of the light intensity sensor 40. In this manner, in the present embodiment, even when the color separating system 21, the liquid crystal panel unit 22, or the like is degraded due to aging and unevenness is generated in the image projected on the projection surface, the correction circuit can perform the unevenness correction to provide the projected image without the unevenness.

Third Embodiment

Next, referring to FIGS. 14 to 17, an image projection apparatus in a third embodiment of the present invention will be described. The image projection apparatus in the present embodiment allows correction of the brightness of the image projected on the projection surface, with a simple configuration, while the image is projected.

Figure 14:
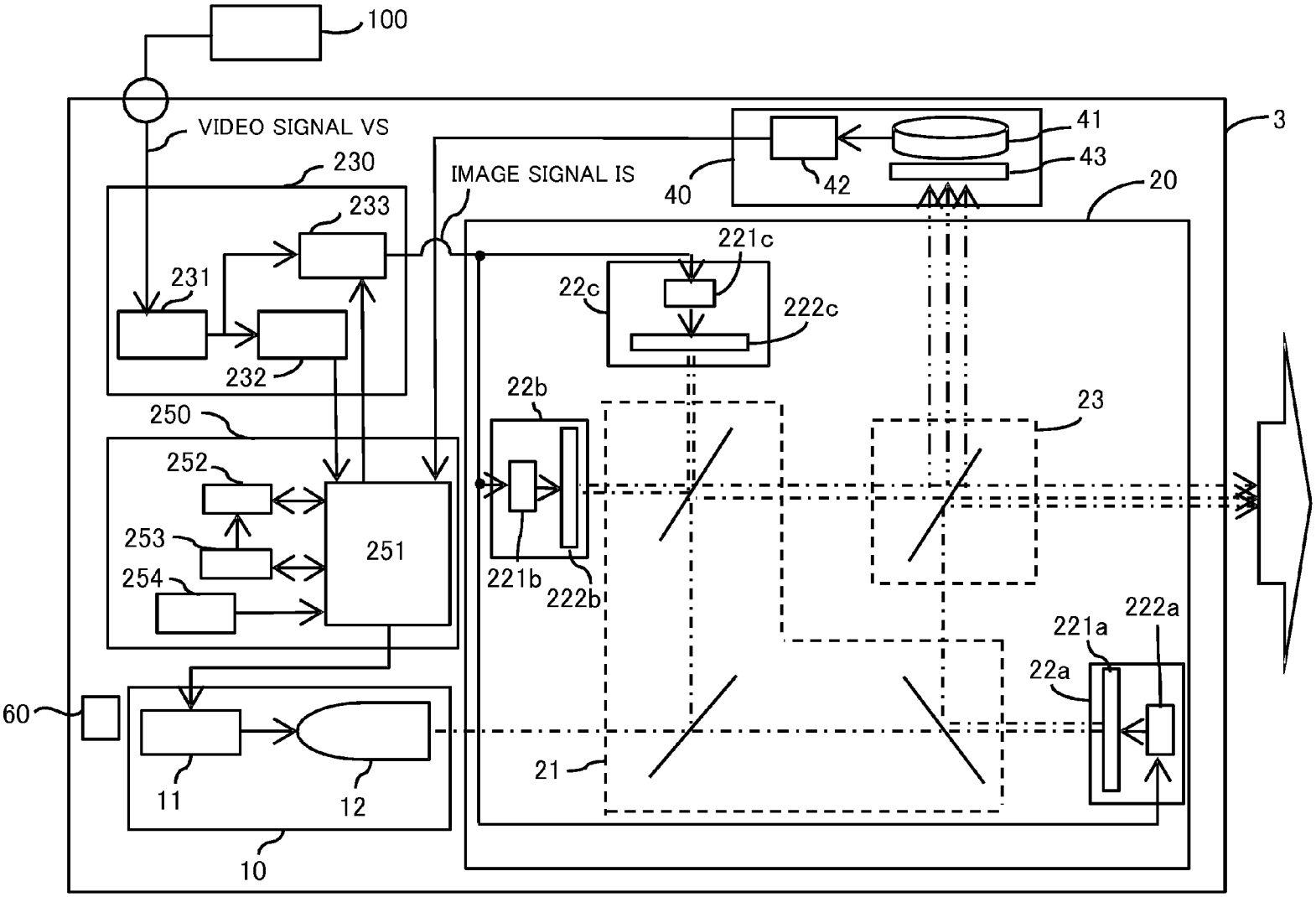
FIG. 14 is a schematic configuration diagram of an image projection apparatus in a third embodiment.

FIG. 14 is a schematic configuration diagram of an image projection apparatus (projector 3) in the present embodiment. In FIG. 14, the same elements as those in the first embodiment (FIG. 1) will be denoted by the same reference numerals and the duplicate descriptions thereof will be omitted. The projector 3 in the present embodiment and the projector 1 in the first embodiment are different from each other in that the projector 3 includes an image processing engine 230 and a correction circuit 250 in place of the image processing engine 30 and the correction circuit 50 in the first embodiment, respectively.

The image processing engine 230 (image processing unit includes an image conversion circuit 231, an image analysis circuit 232, and an image correction circuit 233. The image conversion circuit 231 converts the video signal VS into the image signal IS based on the various setting values for changing the display state of the image, such as brightness, contrast, and a color adjustment. The image conversion circuit 231 then outputs the image signal IS to the image analysis circuit 232 and the image correction circuit 233. The image analysis circuit 232 calculates a histogram for the image signal IS input from the image conversion circuit 231 and outputs the calculated histogram to a CPU 251 of the correction circuit 250. The image correction circuit 233 performs, on the image signal IS converted by the image conversion circuit 231, an image conversion based on the correction value of the brightness of the image output from the CPU 251 of the correction circuit 250, and outputs the image signal IS subjected to the image conversion to the panel driving circuit 221. In this manner, the image processing engine 230 converts the externally input signal VS into the image signal IS to be displayed on the liquid crystal panel unit 22 (22*a*, 22*b*, and 22*c*), and outputs it to the panel driving circuit 221 (221*a*, 221*b*, and 221*c*).

The correction circuit 250 includes the CPU 251, a memory 252, and a correction value setting circuit 253. The CPU 251 calculates the correction value of the brightness of an image newly projected on the projection surface based on the histogram output from the image analysis circuit 232 and the output value of the light intensity sensor 40. The CPU 251 then outputs a correction result to the light source driving circuit 11 or the image correction circuit 233, depending on the correction method. When the correction amount of the correction value of the light intensity sensor value per region of the displayed image changes, the CPU 251 outputs the correction value change signal to the correction value setting circuit 53 and exchanges data therewith. The memory 252 stores the correction value of the brightness of the image projected on the projection surface as illustrated in FIGS. 15A to 15C and various parameters for calculating the correction value, and exchanges data with the CPU 251. The correction value setting circuit 253 changes, according to the correction value change signal from the CPU 251, the correction value of the light intensity sensor value per region of the displayed image stored in the memory 52.

Next, a method of correcting, with a simple configuration, an image brightness change during an image projection will be described. In the present embodiment, as in the first embodiment, the correction is performed with the nine regions of 3×3 dividing the displayed image, but is not limited thereto. The divided nine regions are referred to as regions A to I, respectively.

Referring to FIGS. 15A to 15C, data tables for correcting the image brightness stored in the memory 252 will be described. FIG. 15A is the data table that illustrates an increment of the output value of the light intensity sensor 40 for one pixel at luminance PV and is used for calculating an increment $EV_N$ of the output value of the light intensity sensor 40 per region. FIG. 15B is the data table storing the correction value $n_3$ of the output value of the light intensity sensor 40 set for each of the divided regions A to I and the output value of the light intensity sensor 40 $SV_{BK}$ at all-black display. The data table in FIG. 15B is used in calculating the predicted output value PSV of the light intensity sensor 40 based on the increment of the output value of the light intensity sensor 40 per region. FIG. 15C is the data table illustrating a relation between the correction value Bri of the image brightness and the change amount $cPow_n$ of the supplied electrical power to the lamp 12, and is used in correcting the brightness of the image through the light source control.

FIG. 16 is a data table for correcting the image brightness stored in the image correction circuit 233 and illustrates a relation between the correction value Bri of the image brightness and the γ value change amount $c\gamma_n$. The data table in FIG. 16 is used for correcting the brightness of the image through the color tone control.

Figure 17:
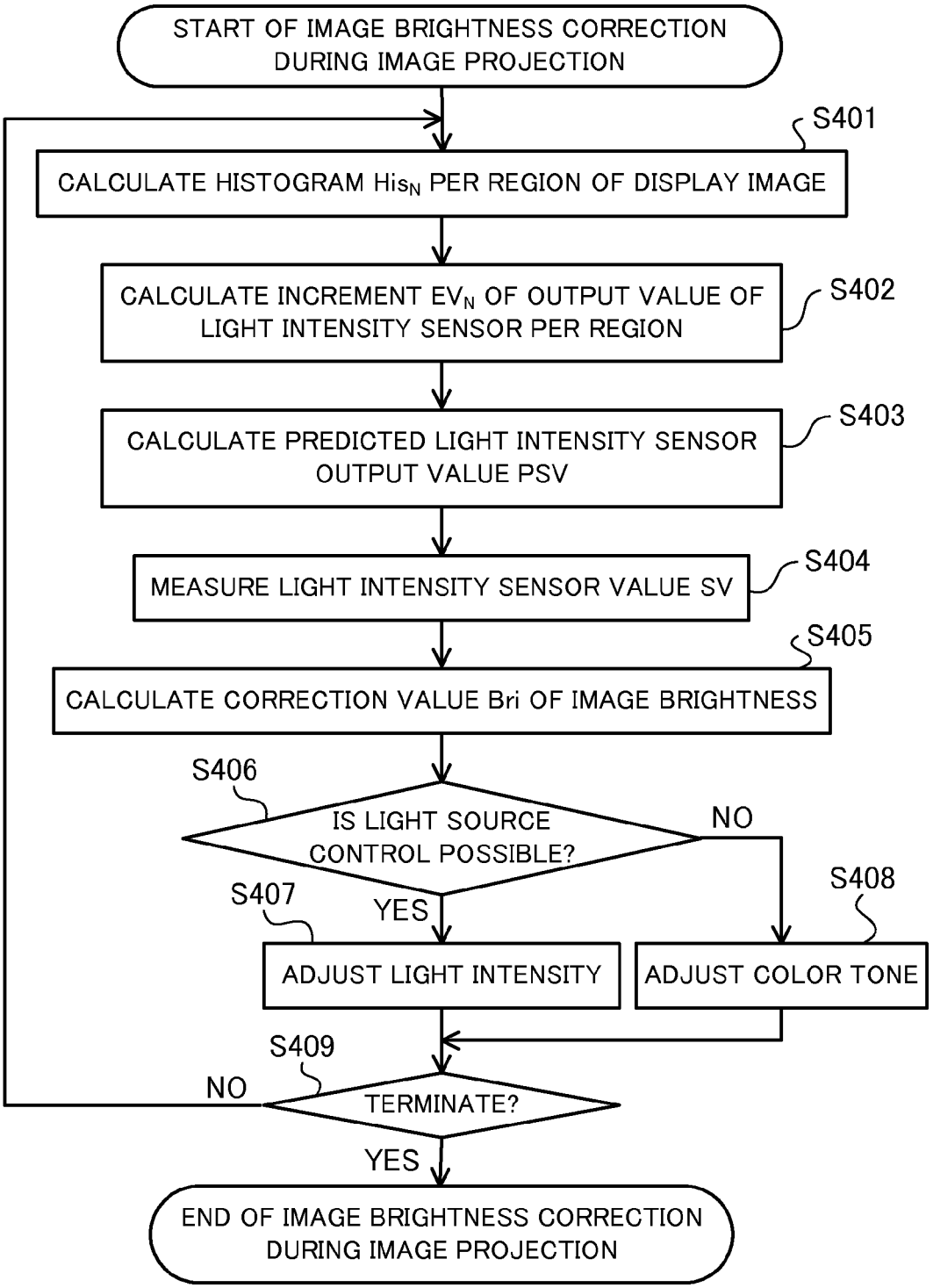
FIG. 17 is a flowchart of a method of correcting brightness of an image projected on a projection surface during an image projection in the third embodiment.

Next, referring to FIG. 17, a method of correcting, during an image projection, a change in the brightness of an image projected on the projection surface will be described. FIG. 17 is a flowchart of the method of correcting, during the image projection, the brightness of the image projected on the projection surface. Steps in FIG. 17 are each performed mainly based on a command from the CPU 251. In the present embodiment, the correction of the brightness of the projected image is constantly performed while the lamp unit 10 of the projector 3 is turned on, but is not limited to this configuration. Other configurations may be applied as appropriate such that the correction of the brightness of the projected image may be performed in a certain period of time, for example.

When the correction of the brightness of the image is started, first at step S401, the image conversion circuit 231 converts the video signal VS supplied from the image supply apparatus 100 such as a personal computer into the image signal IS. This conversion is performed based on various setting values for changing the display state of the image, such as brightness, contrast, and a color adjustment. The image conversion circuit 231 then outputs the image signal IS to the image analysis circuit 232 and the image correction circuit 233. Subsequently, the image analysis circuit 232 calculates, based on the image signal input from the image conversion circuit 231, a histogram $His_N$ (N=A to I) for each of the regions A to I (per region of the image), and outputs it to the CPU 251 of the correction circuit 250. Then, the image correction circuit 233 outputs, according to the γ value set for the image signal IS converted by the image conversion circuit 231, the image signal IS with the corrected brightness of the image to the panel driving circuit 221. The panel driving circuit 221 drives the liquid crystal panel 222 to modulate light from the lamp 12 according to the image signal IS and, thereby displaying the image on the projection surface.

Subsequently at step S402, using the histogram $His_N$ calculated at step S401 and the data table of FIG. 15A set in the memory 252, the CPU 251 calculates the increment (increased amount) $EV_N$ of the output value of the light intensity sensor 40 per region. The increment $EV_N$ of the output value of the light intensity sensor 40 per region is expressed in the following expression (11).

$$EV_N = \sum_{PV=0}^{Grad} \{IV_{PV} \times His_{NPV}\} \tag{11}$$

In expression (11), $His_{NPV}$ represents the number of pixels of luminance PV included in region N, $IV_{PV}$ represents the increment of the output value of the light intensity sensor for luminance PV for one pixel, and Grad represents a maximum luminance value. In this manner, using the histogram, the CPU 251 calculates the increment of the output value (measured value) of the light intensity sensor 40 per region of the image.

Subsequently at step S403, the CPU 251 calculates the predicted output value PSV of the light intensity sensor 40. The predicted output value PSV of the light intensity sensor 40 is calculated based on the increment $EV_N$ of the output value of the light intensity sensor 40 calculated at step S402, the correction value $n_3$ set to region N in the data table of FIG. 15B, and the output value $SV_{BK}$ of the light intensity sensor 40 at all-black display. The predicted output value PSV of the light intensity sensor 40 is expressed in the following expression (12).

$$PSV=EV_A\times a_2+EV_B\times b_2+EV_C\times c_2+EV_D\times d_2+EV_E\times e_2+EV_F\times f_2+EV_G\times g_2+EV_H\times h_2+EV_I\times i_2+SV_{BK} \tag{12}$$

In expression (12), $n_2$ represents the correction value set to region n, and $SV_{BK}$ represents the output value of the light intensity sensor at all-black display. In this manner, the CPU 251 calculates the predicted output value PSV of the light intensity sensor 40 based on the increased amount (increment $EV_N$).

Next at step S404, the light intensity sensor 40 measures the light intensity of the image displayed at step S401 and outputs the light intensity sensor value SV as the output value (measured value) to the CPU 251. Subsequently at step S405, the CPU 251 calculates the image brightness correction value Bri. The correction value Bri of the image brightness is calculated based on the predicted output value PSV of the light intensity sensor 40 calculated at step S403 and the output value of the light intensity sensor 40 (the light intensity sensor value SV) measured at step S404, and is expressed in the following expression (13).

$$Bri=PSV-SV \tag{13}$$

In this manner, the CPU 251 calculates the correction value using the measured value of the light intensity sensor 40 (the light intensity sensor value SV) and the predicted output value PSV.

Subsequently at step S406, the CPU 251 determines whether the light source control is possible for the correction value Bri of the image brightness calculated at step S405. When the light source control is possible, the flow proceeds to step S407. On the other hand, when the light source control is impossible, the CPU 251 outputs the correction value Bri of the image brightness to the image correction circuit 233 and the flow proceeds to step S408. The light source control is impossible if, for example, the supplied electrical power to the lamp 12 exceeds 100% when the light intensity of the lamp is increased, or the supplied electrical power to the lamp 12 is set to the lower limit when the light intensity of the lamp is decreased.

At step S407, using the data table of FIG. 15C stored in the memory 252, the CPU 251 calculates the supplied electrical power to the lamp 12 based on the correction value Bri of the image brightness calculated at step S405. The CPU 251 then outputs the light intensity control signal corresponding to the electrical power supplied to the lamp 12 to the light source driving circuit 11. The light source driving circuit 11 controls the electrical power supplied to the lamp 12 based on the light intensity control signal output from the CPU 251.

At step S408, using data table of FIG. 16 stored in the image correction circuit 233, the CPU 251 calculates the γ value change amount $c\gamma_n$ from the correction value Bri of the image brightness output from the CPU 251 at step S406 and sets the γ value.

Subsequently at step S409, the CPU 251 determines whether to terminate the correction of the brightness of the projected image. When the correction is not to be terminated, the flow returns to step S401. On the other hand, when the correction is to be terminated, the flow terminates. In the present embodiment, the correction of the brightness of the projected image is terminated on condition that the lamp unit 10 of the projector 3 is turned off, but the termination is not limited to this condition.

The control described above allows, when the brightness of an image on the projection surface changes during an image projection, the adjustment (correction) by the correction circuit is performed on the brightness of the image projected on the projection surface, thereby allowing the intensity of projection light to be optionally adjusted with high accuracy at low cost. In the present embodiment, the correction of the brightness of the image projected on the projection surface is achieved by performing both the light source control and the color tone control, but may be achieved by performing only one of them, for example, and other configurations are also applicable as appropriate. In the present embodiment, the predicted output value of the light intensity sensor 40 is calculated by using a histogram per region of the projected image, but the calculation is not limited to this configuration. The predicted output value of the light intensity sensor 40 may be calculated by using an average luminance per region, for example, and other configurations are also applicable as appropriate.

As described above, the present embodiment allows, when the component such as the lamp unit 10 is degraded by aging and the brightness is changed, the adjustment by the correction circuit on the brightness of the image projected on the projection surface even during an image projection, thereby optionally adjusting the intensity of projection light. When a component (constituting component) constituting the image projection apparatus (projector) has changed and a correlation between the output value of the light intensity sensor 40 and the brightness of the image projected on the projection surface has changed, the correction value of the output value of the light intensity sensor 40 per region of the image is changed. This allows, even when the component constituting the image projection apparatus has changed by aging or the like, the brightness of the image projected on the projection surface to be maintained even or constant.

In other words, each of the embodiments provides, at reduced cost for the sensor, the image projection apparatus capable of adjusting the brightness of the projected image with a predetermined accuracy even when a correlation between the measured value of the light intensity measuring unit and the brightness of the projected image has changed. Each of the embodiments also provides, at reduced cost for the sensor, the image projection apparatus capable of correcting the luminance/chromaticity unevenness when the luminance/chromaticity unevenness is generated in the projected image. Each of the embodiments also provides the image projection apparatus capable of correcting change in the illuminance even during an image projection.

The present invention provides the image projection apparatus and the image display system that are highly accurate at low cost.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-144055, filed on Jul. 10, 2013, which is hereby incorporated by reference herein in its entirety.

What is claimed is:

1. An image projection apparatus configured to project an image on a projection surface, the image projection apparatus comprising:

a light modulation unit configured to modulate light from a light source unit;

an image processing unit configured to generate an image signal to be input to the light modulation unit;

a light intensity measuring unit disposed in the image projection apparatus and configured to measure an intensity of part of the light modulated by the light modulation unit;

a light guide optical system configured to guide the part of the light to the light intensity measuring unit and another part of the light to the projection surface; and a correction unit configured to correct brightness of the image projected on the projection surface based on a video signal supplied to the image projection apparatus and a measurement result of the light intensity measuring unit.

2. The image projection apparatus according to claim 1, wherein the correction unit includes a setting unit configured to set a correction value settable per region of the image based on the video signal and the measurement result.

3. The image projection apparatus according to claim 1, wherein the correction unit is configured to correct the brightness of the image while the image projection apparatus projects the image as a moving image.

4. The image projection apparatus according to claim 1, further comprising a correction switch, wherein the correction unit is configured to correct the brightness of the image based on an operation of the correction switch.

5. The image projection apparatus according to claim 1, wherein the correction unit is configured to output a control signal generated based on the correction value to at least one of the light source unit and the image processing unit to correct the brightness of the image projected on the projection surface.

6. The image projection apparatus according to claim 1, wherein the correction unit is configured to perform a correction based on the correction value to achieve an even luminance distribution of the image projected on the projection surface.

7. The image projection apparatus according to claim 1, wherein the correction unit includes a setting unit configured to set the correction value based on information per region of the image and the measurement result of the light intensity measuring unit.

8. The image projection apparatus according to claim 7, wherein the information is image luminance per region of the image corresponding to a test pattern.

9. The image projection apparatus according to claim 7, wherein the setting unit changes the correction value when a correlation between the information per region of the image and the measurement result of the light intensity measuring unit has changed.

10. The image projection apparatus according to claim 9, wherein, in order to change the correction value, the correction unit is configured to:

acquire a plurality of first values each measured by the light intensity measuring unit per region of the image while a predetermined image is displayed per region of the image, acquire a second value measured by the light intensity measuring unit while a black image is displayed, subtract the second value from each of the first values to calculate a plurality of third values, calculate a fourth value as a sum of the third values, and divide each of the third values by the fourth value to calculate the correction value.

11. The image projection apparatus according to claim 1, wherein:

the image processing unit is capable of performing a color adjustment per region of the image, and the correction unit is configured to correct at least one of luminance unevenness and chromaticity unevenness of the image based on a second correction value.

12. The image projection apparatus according to claim 11, wherein the correction unit is configured to:

acquire image luminance information per region of the image while a predetermined image is displayed per region of the image, calculate a predicted value of the measurement result of the light intensity measuring unit based on the image luminance information and the correction value, and calculate the second correction value based on the measurement result of the light intensity measuring unit and the predicted value.

13. The image projection apparatus according to claim 11, wherein the correction unit is configured to change a gamma value per region of the image based on the second correction value.

14. The image projection apparatus according to claim 1, wherein the correction unit is configured to correct the brightness of the image projected on the projection surface while the image is projected.

15. The image projection apparatus according to claim 14, wherein the image processing unit is configured to calculate a histogram per region of the image and output the histogram to the correction unit, and wherein the correction unit is configured to:

calculate an increased amount of the measurement result of the light intensity measuring unit per region of the image based on the histogram, calculate a predicted value of the light intensity measuring unit based on the increased amount, and calculate the correction value based on the measurement result of the light intensity measuring unit and the predicted value.

16. The image projection apparatus according to claim 1, wherein the correction unit further includes a storage unit that stores the correction value.

17. The image processing apparatus according to claim 1, wherein the correction value is set independently for each color of R, G, and B.

18. The image projection apparatus according to claim 1, wherein the light source unit is capable of adjusting the intensity of light by controlling a supplied electrical power.

19. The image projection apparatus according to claim 1, wherein the light source unit is capable of adjusting the intensity of light by controlling a duty ratio.

20. The image projection apparatus according to claim 1, wherein the image processing unit is configured to correct the brightness of the image by multiplying a gradation value included in the image signal by a correction coefficient based on a command from the correction unit.

21. The image projection apparatus according to claim 1, wherein the image processing unit is configured to correct the brightness of the image by offsetting a gradation value included in the image signal based on a command from the correction unit.

22. An image display system comprising:

an image projection apparatus configured to project an image on a projection surface; and an image supply apparatus configured to supply image information to the image projection apparatus, wherein the image projection apparatus includes:

a light modulation unit configured to modulate light from a light source unit;

an image processing unit configured to generate an image signal to be input to the light modulation unit;

a light intensity measuring unit disposed in the image projection apparatus and configured to measure an intensity of part of the light modulated by the light modulation unit;

a light guide optical system configured to guide the part of the light to the light intensity measuring unit and another part of the light to the projection surface; and a correction unit configured to correct brightness of the image projected on the projection surface based on a video signal supplied to the image projection apparatus and a measurement result the light intensity measuring unit.

* * * * *